US008144142B2

(12) United States Patent
Yamate

(10) Patent No.: US 8,144,142 B2
(45) Date of Patent: Mar. 27, 2012

(54) DRIVE CIRCUIT AND DISPLAY DEVICE

(75) Inventor: Kazunori Yamate, Osaka (JP)

(73) Assignee: Panasonic Corporation, Osaka (JP)

( * ) Notice: Subject to any disclaimer, the term of this patent is extended or adjusted under 35 U.S.C. 154(b) by 1089 days.

(21) Appl. No.: 11/911,978

(22) PCT Filed: Apr. 17, 2006

(86) PCT No.: PCT/JP2006/308046

§ 371 (c)(1),
(2), (4) Date: Oct. 19, 2007

(87) PCT Pub. No.: WO2006/115095

PCT Pub. Date: Nov. 2, 2006

(65) Prior Publication Data

US 2009/0073153 A1 Mar. 19, 2009

(30) Foreign Application Priority Data

Apr. 21, 2005 (JP) ..... 2005-123224

(51) Int. Cl.
*G09G 5/00* (2006.01)

(52) U.S. Cl. ..... 345/211; 345/60; 345/204; 315/169.4

(58) Field of Classification Search ..... 345/55–58, 345/60–63, 76, 87, 208, 204, 211–213, 77; 315/169.3–169.4

See application file for complete search history.

(56) References Cited

U.S. PATENT DOCUMENTS 4,866,349 A 9/1989 Weber et al.
5,659,339 A * 8/1997 Rindal et al. ..... 345/212
5,973,906 A 10/1999 Stevenson et al.
6,011,355 A 1/2000 Nagai
6,140,984 A 10/2000 Kanazawa et al.
6,373,452 B1 4/2002 Ishii et al.
6,633,285 B1 * 10/2003 Kigo et al. ..... 345/204
2002/0180465 A1 * 12/2002 Novak ..... 324/707
2003/0107452 A1 6/2003 Novak (Continued)

FOREIGN PATENT DOCUMENTS

CN 1337036 2/2002

(Continued)

OTHER PUBLICATIONS

English Language Abstract of JP 11-85099.

(Continued)

*Primary Examiner* — Alexander Eisen
*Assistant Examiner* — Christopher E Leiby
(74) *Attorney, Agent, or Firm* — Greenblum & Bernstein, P.L.C.

(57) ABSTRACT

A first impedance control circuit includes a plurality of capacitors connected in parallel with a first transistor, and a second impedance control circuit includes a plurality of capacitors connected in parallel with a second transistor. Capacitors in the first impedance control circuit respectively have different capacitance values, and capacitors in the second impedance control circuit respectively have different capacitance values. The respective self-resonance frequencies of the capacitors in the first impedance control circuit differ, and the respective self-resonance frequencies of the capacitors in the second impedance control circuit differ. Switching noises each having a plurality of frequencies generated from first and second transistors are respectively absorbed in a power supply terminal and a ground terminal through the first and second impedance control circuits.

10 Claims, 17 Drawing Sheets

U.S. PATENT DOCUMENTS

| | | | | |
|---|---|---|---|---|
| 2003/0107867 | A1* | 6/2003 | Iwase et al. | 361/301.4 |
| 2003/0169121 | A1 | 9/2003 | Grebenkemper | |
| 2006/0109605 | A1 | 5/2006 | Matters-Kammerer | |

FOREIGN PATENT DOCUMENTS

| | | |
|---|---|---|
| EP | 1160756 | 12/2001 |
| JP | 63-101897 | 5/1988 |
| JP | 02-029779 | 1/1990 |
| JP | 3-183211 | 8/1991 |
| JP | 6-045899 | 2/1994 |
| JP | 6-45899 | 2/1994 |
| JP | 2541325 | 7/1996 |
| JP | 11-85099 | 3/1999 |
| JP | 2001-24491 | 1/2001 |
| JP | 3369535 | 11/2002 |
| JP | 2003-111474 | 4/2003 |
| KR | 100262058 | 7/2000 |
| KR | 100301352 | 6/2001 |
| KR | 100739596 | 7/2007 |
| WO | 01/35383 | 5/2001 |
| WO | 2004/049565 | 6/2004 |

OTHER PUBLICATIONS

English Language Abstract of JP 3-183211.
English Language Abstract of JP 2001-24491.
English Language Abstract of JP 2003-111474.
English Language Abstract of JP 6-45899.
English Language Abstract of JP 3369535.
English Language Abstract of JP 02-029779.
English language Abstract of KR 100739596, Jul. 9, 2007.

* cited by examiner

DRIVE CIRCUIT AND DISPLAY DEVICE

TECHNICAL FIELD

The present invention relates to a drive circuit for driving a capacitive load by a driving pulse and a display device using the drive circuit.

BACKGROUND ART

Known as conventional drive circuits for driving capacitive loads are sustain drives for driving sustain electrodes in plasma display panels, for example.

FIG. 16 is a circuit diagram showing the configuration of a conventional sustain driver. As shown in FIG. 16, a sustain driver 400 includes a recovery capacitor C401, a recovery coil L401, switches SW11, SW12, SW21, and SW22, and diodes D401 and D402.

The switch SW11 is connected between a power supply terminal V4 and a node N11, and the switch SW12 is connected between the node N11 and a ground terminal. A power supply voltage Vsus is applied to the power supply voltage V4. The node N11 is connected to 480 sustain electrodes, for example. A panel capacitance Cp corresponding to the total capacitance between the plurality of sustain electrodes and the ground terminal is shown in FIG. 16.

The recovery capacitor C401 is connected between a node N13 and the ground terminal. The switch SW21 and the diode D401 are connected in series between the node N13 and a node N12, and the diode D402 and the switch SW22 are connected in series between the node N12 and the node N13. The recovery coil L401 is connected between the node N12 and the node N11.

FIG. 17 is a timing chart showing the operations in a sustain time period of the sustain driver 400 shown in FIG. 16. A voltage of the node N11 shown in FIG. 16 and the respective operations of the switches SW21, SW11, SW22, and SW12 are shown in FIG. 17. An ON state and an OFF state of each of the switches SW21, SW11, SW22, and SW12 are respectively indicated by a high level and a low level.

First, in a time period Ta, the switch SW21 is turned on, and the switch SW12 is turned off. At this time, the switches SW11 and SW22 are turned off. Thus, a potential at the node N11 gently rises due to LC resonance caused by the recovery coil L401 and the panel capacitance Cp. Then, in a time period Tb, the switch SW21 is turned off, and the switch SW11 is turned on. Thus, the potential at the node N11 rapidly rises. In a time period Tc, the potential at the node N11 is fixed to the power supply voltage Vsus.

Then, in a time period Td, the switch SW11 is turned off, and the switch SW22 is turned on. Thus, the potential at the node N11 gently falls due to LC resonance caused by the recovery coil L401 and the panel capacitance Cp. Thereafter, in a time period Te, the switch SW22 is turned off, and the switch SW12 is turned on. Thus, the potential at the node N11 rapidly falls, and is fixed to the ground potential. A periodical sustain pulse Psu is applied to the plurality of sustain electrodes by repeating the above-mentioned operations in the sustain time period.

As described in the foregoing, a rise portion and a fall portion of the sustain pulse Psu are respectively composed of LC resonance portions in the time periods Ta and Td by the operation of the switch SW21 or SW22 and edges in the time periods Tb and Te by an on-operation of the switch SW11 or SW12 (see Patent Document 1).

[Patent Document 1] JP 3369535 B

DISCLOSURE OF THE INVENTION

Problems to be Solved by the Invention

Each of the switches SW11, SW12, SW21, and SW22 is generally composed of an FET (Field Effect Transistor) serving as a switching element. Each of the FETs has a drain-source capacitance as a parasitic capacitance. An interconnection connected to each of the FETs has an inductance component. When the switch SW11 or the like performs a switching operation, therefore, a switching noise is generated. Thus, the switching noise is applied to the plurality of sustain electrodes. The plurality of sustain electrodes serve as an antenna, to undesirably radiate an electromagnetic wave.

Therefore, in the drive circuit disclosed in Patent Document 1, one capacitor is connected in parallel between the drain and the source of each of the FETs, to absorb the switching noise in the FET.

In this case, however, only the switching noise having a particular frequency component can be absorbed. Therefore, the switching noise having various frequency components cannot be sufficiently restrained. As a result, the radiation of a high-frequency electromagnetic wave cannot be sufficiently restrained.

This radiation of the high-frequency electromagnetic wave having various frequency components may exert an adverse electromagnetic effect on the other electronic equipment. Therefore, it is desired that the undesired radiation of the high-frequency electromagnetic wave over a wide band is sufficiently restrained.

An object of the present invention is to provide a drive circuit capable of sufficiently restraining the undesired radiation of a high-frequency electromagnetic wave over a wide band and a display device using the drive circuit.

Means for Solving the Problems (1)

According to an aspect of the present invention, a drive circuit for supplying a driving pulse to a capacitive load including a display element through a pulse supply path includes a first voltage source that supplies a first voltage to raise the driving pulse, a second voltage source that supplies a second voltage lower than the first voltage to lower the driving pulse, a first switching element having one end receiving the first voltage from the first voltage source, a second switching element having one end receiving the second voltage from the second voltage source, a first interconnection having one end connected to the other end of the first switching element and the other end connected to the pulse supply path, a second interconnection having one end connected to the other end of the second switching element and the other end connected to the pulse supply path, a first impedance control circuit connected in parallel with the first switching element between the one end and the other end of the first switching element, and a second impedance control circuit connected in parallel with the second switching element between the one end and the other end of the second switching element, in which the first and second switching elements operate to apply the driving pulse to the capacitive load in a sustain time period during which the display element is lighten, the first impedance control circuit includes a plurality of first capacitive elements connected in parallel with the first switching element, the second impedance control circuit includes a plurality of second capacitive elements connected in parallel with the second switching element, each of the plurality of first capacitive elements includes a capacitance component and an inductance component, and the values of the capacitance components in the plurality of first capacitive elements differ from one another, and each of the plurality of second capacitive elements includes a capacitance component and an inductance component, and the values of the capacitance components in the plurality of second capacitive elements differ from one another.

In the drive circuit, the first and second switching elements operate in the sustain time period, and the driving pulse is supplied to the capacitive load including the display element through the pulse supply path. In this case, the voltage of the driving pulse is raised by the first voltage supplied by the first voltage source, while being lowered by the second voltage supplied by the second voltage source. The first and second switching elements perform a switching operation, so that switching noises each having a plurality of frequency components are respectively generated.

Each of the plurality of first capacitive elements in the first impedance control circuit includes the capacitance component and the inductance component, so that it self-resonates at a particular frequency. Thus, the impedance of each of the first capacitive elements is reduced at a particular frequency. Further, the respective values of the capacitance components in the plurality of first capacitive elements differ, so that the respective self-resonance frequencies of the plurality of first capacitive elements differ. Thus, the impedance of the first impedance control circuit is reduced at a plurality of frequencies. Therefore, the switching noise having a plurality of frequencies generated by the first switching element is absorbed in the first voltage source through the first impedance control circuit, so that the effect of the switching noise on the capacitive load including the display element is reduced through the pulse supply path.

Similarly, each of the plurality of second capacitive elements in the second impedance control circuit includes the capacitance component and the inductance component, so that it self-resonates at a particular frequency. Thus, the impedance of each of the second capacitive elements is reduced at a particular frequency. Further, the respective values of the capacitance components in the plurality of second capacitive elements differ, so that the respective self-resonance frequencies of the plurality of second capacitive elements differ. Thus, the impedance of the second impedance-control circuit is reduced at a plurality of frequencies. Therefore, the switching noise having a plurality of frequencies generated by the second switching element is absorbed in the second voltage source through the second impedance control circuit, so that the effect of the switching noise on the capacitive load including the display element is reduced through the pulse supply path.

These results allow the undesired radiation of a high-frequency electromagnetic wave over a wide band from the capacitive load to be sufficiently restrained.

(2)

The drive circuit may further include an inductance element having one end connected to the capacitive load through the pulse supply path, a recovering capacitive element for recovering charges from the capacitive load, first and second unidirectional conductive elements, and third and fourth switching elements, in which the first unidirectional conductive element and the third switching element may be connected in series between the other end of the inductance element and the recovering capacitive load so as to allow the supply of a current from the recovering capacitive element to the inductance element, and the second unidirectional conductive element and the fourth switching element may be connected in series between the other end of the inductance element and the recovering capacitive element so as to allow the supply of a current from the inductance element to the recovering capacitive element.

In this case, the current is supplied to the capacitive load from the recovering capacitive element through the first unidirectional conductive element, the third switching element, the inductance element, and the pulse supply path. Further, the current is supplied to the recovering capacitive element from the capacitive load through the pulse supply path, the inductance element, the second unidirectional conductive element, and the fourth switching element.

Thus, apart of the rising edge of the driving pulse supplied to the capacitive load including the display element occurs by supplying the current to the capacitive load from the recovering capacitive element, and a part of the falling edge of the driving pulse occurs by supplying the current to the recovering capacitive element from the capacitive load. Consequently, the power consumption can be reduced while sufficiently restraining the undesired radiation of the high-frequency electromagnetic wave over a wide band from the capacitive load.

(3)

The drive circuit may further include a third impedance control circuit connected in parallel with the third switching element, and a fourth impedance control circuit connected in parallel with the fourth switching element, in which the third impedance control circuit may include a plurality of third capacitive elements connected in parallel with the third switching element, the fourth impedance control circuit may include a plurality of fourth capacitive elements connected in parallel with the fourth switching element, each of the plurality of third capacitive elements may include a capacitance component and an inductance component, and the values of the capacitance components in the plurality of third capacitive elements may differ from one another, and each of the plurality of fourth capacitive elements may include a capacitance component and an inductance component, and the values of the capacitance components in the plurality of fourth capacitive elements may differ from one another.

In this case, each of the plurality of third capacitive elements in the third impedance control circuit includes the capacitance component and the inductance component, so that it self-resonates at a particular frequency. Thus, the impedance of each of the third capacitive elements is reduced at a particular frequency. Further, the respective values of the capacitance components in the plurality of third capacitive elements differ, so that the respective self-resonance frequencies of the plurality of third capacitive elements differ. Thus, the impedance of the third impedance control circuit is reduced at a plurality of frequencies. Therefore, the switching noise having a plurality of frequencies generated by the third switching element is absorbed in the recovering capacitive element through the third impedance control circuit, so that the effect of the switching noise on the capacitive load including the display element is reduced through the pulse supply path.

Similarly, each of the plurality of fourth capacitive elements in the fourth impedance control circuit includes the capacitance component and the inductance component, so that it self-resonates at a particular frequency. Thus, the impedance of each of the fourth capacitive elements is reduced at a particular frequency. Further, the respective values of the capacitance components in the plurality of fourth capacitive elements differ, so that the respective self-resonance frequencies of the plurality of fourth capacitive elements differ. Thus, the impedance of the fourth impedance control circuit is reduced at a plurality of frequencies. Therefore, the switching noise having a plurality of frequencies generated by the fourth switching element is absorbed in the recovering capacitive element through the fourth impedance control circuit, so that the effect of the switching noise on the capacitive load including the display element is reduced through the pulse supply path.

These results allow the undesired radiation of the high-frequency electromagnetic wave over a wide band from the capacitive load to be sufficiently restrained.

(4)

The drive circuit may further include a third impedance control circuit connected in parallel with the first unidirectional conductive element, and a fourth impedance control circuit connected in parallel with the second unidirectional conductive element, in which the third impedance control circuit may include a plurality of third capacitive elements connected in parallel with the first unidirectional conductive element, the fourth impedance control circuit may include a plurality of fourth capacitive elements connected in parallel with the second unidirectional conductive element, each of the plurality of third capacitive elements may include a capacitance component and an inductance component, and the values of the capacitance components in the plurality of third capacitive elements may differ from one another, and each of the plurality of fourth capacitive elements may include a capacitance component and an inductance component, and the values of the capacitance components in the plurality of fourth capacitive elements may differ from one another.

In this case, each of the plurality of third capacitive elements in the third impedance control circuit includes the capacitance component and the inductance component, so that it self-resonates at a particular frequency. Thus, the impedance of each of the third capacitive elements is reduced at a particular frequency. Further, the respective values of the capacitance components in the plurality of third capacitive elements differ, so that the respective self-resonance frequencies of the plurality of third capacitive elements differ. Thus, the impedance of the third impedance control circuit is reduced at a plurality of frequencies. Therefore, the switching noise having a plurality of frequencies generated by the first unidirectional conductive element is absorbed in the recovering capacitive element through the third impedance control circuit, so that the effect of the switching noise on the capacitive load including the display element is reduced through the pulse supply path.

Similarly, each of the plurality of fourth capacitive elements in the fourth impedance control circuit includes the capacitance component and the inductance component, so that it self-resonates at a particular frequency. Thus, the impedance of each of the fourth capacitive elements is reduced at a particular frequency. Further, the respective values of the capacitance components in the plurality of fourth capacitive elements differ, so that the respective self-resonance frequencies of the plurality of fourth capacitive elements differ. Thus, the impedance of the fourth impedance control circuit is reduced at a plurality of frequencies. Therefore, the switching noise having a plurality of frequencies generated by the second unidirectional conductive element is absorbed in the recovering capacitive element through the fourth impedance control circuit, so that the effect of the switching noise on the capacitive load including the display element is reduced through the pulse supply path.

These results allow the undesired radiation of the high-frequency electromagnetic wave over a wide band from the capacitive load to be sufficiently restrained.

(5)

The plurality of first capacitive elements may include first to n-th first capacitive elements, the plurality of second capacitive elements may include first to n-th second capacitive elements, and n may be a natural number of not less than two, the n-th first capacitive element out of the first to n-th first capacitive elements may have the smallest capacitance value, the n-th second capacitive element out of the first to n-th second capacitive elements may have the smallest capacitance value, the first impedance control circuit may further include first to (n−1)-th first resistive elements respectively connected in series with the first to (n−1)-th first capacitive elements, and the second impedance control circuit may further include first to (n−1)-th second resistive elements respectively connected in series with the first to (n−1)-th second capacitive elements.

In this case, when anti-resonance occurs between the respective self-resonance frequencies of the first to n-th first capacitive elements, the level of the anti-resonance is reduced by the first to (n−1)-th first resistive elements. Thus, the impedance characteristics are inhibited from being degraded at the anti-resonance frequency.

Similarly, when anti-resonance occurs between the respective self-resonance frequencies of the first to n-th second capacitive elements, the level of the anti-resonance is reduced by the first to (n−1)-th second resistive elements. Thus, the impedance characteristics are inhibited from being degraded at the anti-resonance frequency.

Thus, the switching noise over a wide band is absorbed in the first and second voltage sources through the first and second impedance control circuits. As a result, the undesired radiation of the high-frequency electromagnetic wave over a wide band from the capacitive load can be sufficiently restrained.

(6)

The plurality of first capacitive elements may include first to n-th first capacitive elements, the plurality of second capacitive elements may include first to n-th second capacitive elements, and n may be a natural number of not less than two, the n-th first capacitive element out of the first to n-th first capacitive elements may have the smallest capacitance value, the n-th first second capacitive element out of the first to n-th second capacitive elements may have the smallest capacitance value, the first impedance control circuit may further include first to (n−1)-th first beads cores respectively connected in series with the first to (n−1)-th first capacitive elements, and the second impedance control circuit may further include first to (n−1)-th second beads cores respectively connected in series with the first to (n−1)-th second capacitive elements.

In this case, when anti-resonance occurs between the respective self-resonance frequencies of the first to n-th first capacitive elements, the level of the anti-resonance is reduced by the first to (n−1)-th first beads cores. Thus, the impedance characteristics are inhibited from being degraded at the anti-resonance frequency. At this time, the impedance characteristics are not degraded in a frequency region lower than the self-resonance frequency of the n-th first capacitive element.

Similarly, when anti-resonance occurs between the respective self-resonance frequencies of the first to n-th second capacitive elements, the level of the anti-resonance is reduced by the first to (n−1)-th second beads cores. Thus, the impedance characteristics are inhibited from being degraded at the anti-resonance frequency. In this case, the impedance characteristics are not degraded in a frequency region lower than the self-resonance frequency of the n-th second capacitive element.

Thus, the switching noise over a wide band is absorbed in the first and second voltage sources through the first and second impedance control circuits. As a result, the undesired radiation of the high-frequency electromagnetic wave over a wide band from the capacitive load can be sufficiently restrained.

(7)

Each of the plurality of first capacitive elements may be composed of a first stacked ceramic capacitor, and each of the plurality of second capacitive elements may be composed of a second stacked ceramic capacitor.

In this case, the plurality of first capacitive loads and the plurality of second capacitive loads can sufficiently self-resonate. Thus, the impedance of each of the first capacitive elements and the impedance of each of the second capacitive elements are sufficiently reduced at a particular frequency. As a result, the undesired radiation of the high-frequency electromagnetic wave over a wide band from the capacitive load can be more sufficiently restrained.

(8)

According to another aspect of the present invention, a drive circuit for supplying a driving pulse to a capacitive load including a display element through a pulse supply path includes a first voltage source that supplies a first voltage to raise the driving pulse, a second voltage source that supplies a second voltage lower than the first voltage to lower the driving pulse, first, second, third and fourth switching elements, an inductance element having one end connected to the capacitive load through the pulse supply path, a recovering capacitive element for recovering charges from the capacitive load, first and second unidirectional conductive elements, a first impedance control circuit connected in parallel with the third switching element, and a second impedance control circuit connected in parallel with the fourth switching element, in which the first switching element is connected between the first voltage source and the pulse supply path, the second switching element is connected between the second voltage source and the pulse supply path, the first and second switching elements operate to apply the driving pulse to the capacitive load in a sustain time period during which the display element is lighten, the first unidirectional conductive element and the third switching element are connected in series between the other end of the inductance element and the recovering capacitive load so as to allow the supply of a current from the recovering capacitive element to the inductance element, and the second unidirectional conductive element and the fourth switching element are connected in series between the other end of the inductance element and the recovering capacitive element so as to allow the supply of a current from the inductance element to the recovering capacitive element, the first impedance control circuit includes a plurality of first capacitive elements connected in parallel with the third switching element, the second impedance control circuit includes a plurality of second capacitive elements connected in parallel with the fourth switching element, each of the plurality of first capacitive elements includes a capacitance component and an inductance component, and the values of the capacitance components in the plurality of first capacitive elements differ from one another, and each of the plurality of second capacitive elements includes a capacitance component and an inductance component, and the values of the capacitance components in the plurality of second capacitive elements differ from one another.

In the drive circuit, the first and second switching elements operate in the sustain time period, and the driving pulse is supplied to the capacitive load including the display element through the pulse supply path. In this case, the voltage of the driving pulse is raised by the first voltage supplied by the first voltage source, while being lowered by the second voltage supplied by the second voltage source.

The current is supplied to the capacitive load from the recovering capacitive element through the first unidirectional conductive element, the third switching element, the inductance element, and the pulse supply path. Further, the current is supplied to the recovering capacitive element from the capacitive load through the pulse supply path, the inductance element, the second unidirectional conductive element, and the fourth switching element.

Thus, apart of the rising edge of the driving pulse supplied to the capacitive load including the display element occurs by supplying the current to the capacitive load from the recovering capacitive element, and a part of the falling edge of the driving pulse occurs by supplying the current to the recovering capacitive element from the capacitive load. Consequently, the power consumption can be reduced.

At this time, the third and fourth switching elements perform a switching operation, so that switching noises each having a plurality of frequency components are respectively generated.

In this case, each of the plurality of first capacitive elements in the first impedance control circuit includes the capacitance component and the inductance component, so that it self-resonates at a particular frequency. Thus, the impedance of each of the first capacitive elements is reduced at a particular frequency. Further, the respective values of the capacitance components in the plurality of first capacitive elements differ, so that the respective self-resonance frequencies of the plurality of first capacitive elements differ. Thus, the impedance of the first impedance control circuit is reduced at a plurality of frequencies. Therefore, the switching noise having a plurality of frequencies generated by the third switching element is absorbed in the recovering capacitive element through the first impedance control circuit, so that the effect of the switching noise on the capacitive load including the display element is reduced through the pulse supply path.

Similarly, each of the plurality of second capacitive elements in the second impedance control circuit includes the capacitance component and the inductance component, so that it self-resonates at a particular frequency. Thus, the impedance of each of the second capacitive elements is reduced at a particular frequency. Further, the respective values of the capacitance components in the plurality of second capacitive elements differ, so that the respective self-resonance frequencies of the plurality of second capacitive elements differ. Thus, the impedance of the second impedance control circuit is reduced at a plurality of frequencies. Therefore, the switching noise having a plurality of frequencies generated by the fourth switching element is absorbed in the recovering capacitive element through the second impedance control circuit, so that the effect of the switching noise on the capacitive load including the display element is reduced through the pulse supply path.

These results allow the undesired radiation of a high-frequency electromagnetic wave over a wide band from the capacitive load to be sufficiently restrained.

(9)

According to still another aspect of the present invention, a drive circuit for supplying a driving pulse to a capacitive load including a display element through a pulse supply path includes a first voltage source that supplies a first voltage to raise the driving pulse, a second voltage source that supplies a second voltage lower than the first voltage to lower the driving pulse, first, second, third and fourth switching elements, an inductance element having one end connected to the capacitive load through the pulse supply path, a recovering capacitive element for recovering charges from the capacitive load, first and second unidirectional conductive elements, a first impedance control circuit connected in parallel with the first unidirectional conductive element, and a second impedance control circuit connected in parallel with the second unidirectional conductive element, in which the first switching element is connected between the first voltage source and the pulse supply path, the second switching element is connected between the second voltage source and the pulse supply path, the first and second switching elements operate to apply the driving pulse to the capacitive load in a sustain time period during which the display element is lighten, the first unidirectional conductive element and the third switching element are connected in series between the other end of the inductance element and the recovering capacitive load so as to allow the supply of a current from the recovering capacitive element to the inductance element, the second unidirectional conductive element and the fourth switching element are connected in series between the other end of the inductance element and the recovering capacitive element so as to allow the supply of a current from the inductance element to the recovering capacitive element, the first impedance control circuit includes a plurality of first capacitive elements connected in parallel with the first unidirectional conductive element, the second impedance control circuit includes a plurality of second capacitive elements connected in parallel with the second unidirectional conductive element, each of the plurality of first capacitive elements includes a capacitance component and an inductance component, and the values of the capacitance components in the plurality of first capacitive elements differ from one another, and each of the plurality of second capacitive elements includes a capacitance component and an inductance component, and the values of the capacitance components in the plurality of second capacitive elements differ from one another.

In the drive circuit, the first and second switching elements operate in the sustain time period, and the driving pulse is supplied to the capacitive load including the display element through the pulse supply path. In this case, the voltage of the driving pulse is raised by the first voltage supplied by the first voltage source, while being lowered by the second voltage supplied by the second voltage source.

The current is supplied to the capacitive load from the recovering capacitive load through the first unidirectional conductive element, the third switching element, the inductance element, and the pulse supply path. Further, the current is supplied to the recovering capacitive element from the capacitive load through the pulse supply path, the inductance element, the second unidirectional conductive element, and the fourth switching element.

Thus, a part of the rising edge of the driving pulse supplied to the capacitive load including the display element occurs by supplying the current to the capacitive load from the recovering capacitive element, and a part of the falling edge of the driving pulse occurs by supplying the current to the recovering capacitive element from the capacitive load. Consequently, the power consumption can be reduced.

At this time, the first and second unidirectional conductive elements perform a switching operation, so that switching noises each having a plurality of frequency components are respectively generated.

In this case, each of the plurality of first capacitive elements in the first impedance control circuit includes the capacitance component and the inductance component, so that it self-resonates at a particular frequency. Thus, the impedance of each of the first capacitive elements is reduced at a particular frequency. Further, the respective values of the capacitance components in the plurality of first capacitive elements differ, so that the respective self-resonance frequencies of the plurality of first capacitive elements differ. Thus, the impedance of the first impedance control circuit is reduced at a plurality of frequencies. Therefore, the switching noise having a plurality of frequencies generated by the first unidirectional conductive element is absorbed in the recovering capacitive element through the first impedance control circuit, so that the effect of the switching noise on the capacitive load including the display element is reduced through the pulse supply path.

Similarly, each of the plurality of second capacitive elements in the second impedance control circuit includes the capacitance component and the inductance component, so that it self-resonates at a particular frequency. Thus, the impedance of each of the second capacitive elements is reduced at a particular frequency. Further, the respective values of the capacitance components in the plurality of second capacitive elements differ, so that the respective self-resonance frequencies of the plurality of second capacitive elements differ. Thus, the impedance of the second impedance control circuit is reduced at a plurality of frequencies. Therefore, the switching noise having the plurality of frequencies generated by the second unidirectional conductive element is absorbed in the recovering capacitive element through the second impedance control circuit, so that the effect of the switching noise on the capacitive load including the display element is reduced through the pulse supply path.

These results allow the undesired radiation of a high-frequency electromagnetic wave over a wide band from the capacitive load to be sufficiently restrained.

(10)

According to a further aspect of the present invention, a display device includes a display panel including a capacitive element composed of a plurality of display elements, and a drive circuit for supplying a driving pulse to the capacitive load through a pulse supply path, in which the drive circuit includes a first voltage source that supplies a first voltage to raise the driving pulse, a second voltage source that supplies a second voltage lower than the first voltage to lower the driving pulse, a first switching element having one end receiving the first voltage from the first voltage source, a second switching element having one end receiving the second voltage from the second voltage source, a first interconnection having one end connected to the other end of the first switching element and the other end connected to the pulse supply path, a second interconnection having one end connected to the other end of the second switching element and the other end connected to the pulse supply path, a first impedance control circuit connected in parallel with the first switching element between the one end and the other end of the first switching element, and a second impedance control circuit connected in parallel with the second switching element between the one end and the other end of the second switching element, the first and second switching elements operate to apply the driving pulse to the capacitive load in a sustain time period during which the display element is lighten, the first impedance control circuit includes a plurality of first capacitive elements connected in parallel with the first switching element, the second impedance control circuit includes a plurality of second capacitive elements connected in parallel with the second switching element, each of the plurality of first capacitive elements includes a capacitance component and an inductance component, and the values of the capacitance components in the plurality of first capacitive elements differ from one another, and each of the plurality of second capacitive elements includes a capacitance component and an inductance component, and the values of the capacitance components in the plurality of second capacitive elements differ from one another.

In the display device, the first and second switching elements operate in the sustain time period, and the driving pulse is supplied to the capacitive load including the plurality of display elements in the display panel through the pulse supply path. In this case, the voltage of the driving pulse is raised by the first voltage supplied by the first voltage source, while being lowered by the second voltage supplied by the second voltage source. The first and second switching elements perform a switching operation, so that switching noises each having a plurality of frequency components are respectively generated.

Each of the plurality of first capacitive elements in the first impedance control circuit includes the capacitance component and the inductance component, so that it self-resonates at a particular frequency. Thus, the impedance of each of the first capacitive elements is reduced at a particular frequency. Further, the respective values of the capacitance components in the plurality of first capacitive elements differ, so that the respective self-resonance frequencies of the plurality of first capacitive elements differ. Thus, the impedance of the first impedance control circuit is reduced at a plurality of frequencies. Therefore, the switching noise having the plurality of frequencies generated by the first switching element is absorbed in the first voltage source through the first impedance control circuit, so that the effect of the switching noise on the capacitive load including the display element is reduced through the pulse supply path.

Similarly, each of the plurality of second capacitive elements in the second impedance control circuit includes the capacitance component and the inductance component, so that it self-resonates at a particular frequency. Thus, the impedance of each of the second capacitive elements is reduced at a particular frequency. Further, the respective values of the capacitance components in the plurality of second capacitive elements differ, so that the respective self-resonance frequencies of the plurality of second capacitive elements differ. Thus, the impedance of the second impedance control circuit is reduced at a plurality of frequencies. Therefore, the switching noise having the plurality of frequencies generated by the second switching element is absorbed in the second voltage source through the second impedance control circuit, so that the effect of the switching noise on the capacitive load including the display element is reduced through the pulse supply path.

These results allow the undesired radiation of a high-frequency electromagnetic wave over a wide band from the capacitive load to be sufficiently restrained.

Effects of the Invention

According to the present invention, a switching noise having a plurality of frequencies is reduced, which allows the undesired radiation of a high-frequency electromagnetic wave over a wide band from a capacitive load can be sufficiently restrained.

BEST MODE FOR CARRYING OUT THE INVENTION

Figure 1:
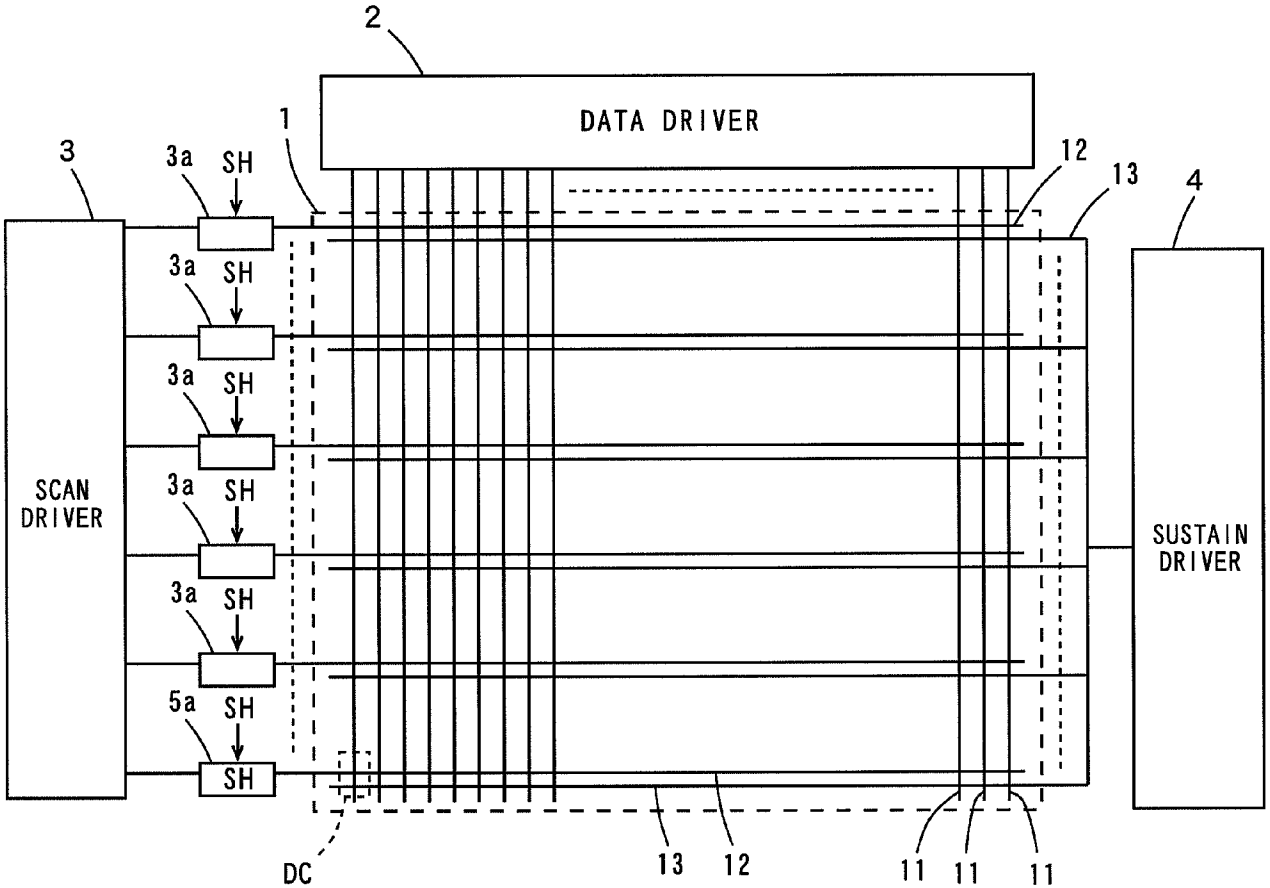
FIG. 1 is a block diagram showing the configuration of a plasma display device using a sustain driver according to a first embodiment of the present invention.

The embodiments of the present invention will be described in detail referring to the drawings. The embodiments below describe a sustain driver used for a plasma display device as an example of a drive circuit according to the present invention.

(1) First Embodiment

(1-1) Configuration of Plasma Display Device

FIG. 1 is a block diagram showing the configuration of a plasma display device using a sustain driver according to a first embodiment of the present invention.

The plasma display device shown in FIG. 1 includes a PDP (Plasma Display Panel) 1, a data driver 2, a scan driver 3, a plurality of scan driver ICs (Integrated Circuits) 3*a*, and a sustain driver 4.

The PDP 1 includes a plurality of address electrodes (data electrodes) 11, a plurality of scan electrodes 12, and a plurality of sustain electrodes 13. The plurality of address electrodes 11 are arranged in a vertical direction on a screen, and the plurality of scan electrodes 12 and the plurality of sustain electrodes 13 are arranged in a horizontal direction on the screen. The plurality of sustain electrodes 13 are connected to one another. A discharge cell DC is formed at each of intersections of the address electrodes 11, the scan electrodes 12, and the sustain electrodes 13. Each of the discharge cells DC constitutes a pixel on the screen. In FIG. 1, only one discharge cell DC is indicated by a dotted line.

The data driver 2 is connected to the plurality of address electrodes 11 in the PDP 1. The plurality of scan driver ICs 3*a* are connected to the scan driver 3. The plurality of scan electrodes 12 in the PDP 1 are respectively connected to the scan driver ICs 3*a*. The sustain driver 4 is connected to the plurality of sustain electrodes 13 in the PDP 1.

The data driver 2 applies write pulses to the corresponding address electrodes 11 in the PDP 1 in response to image data in a writing time period. The plurality of scan driver ICs 3*a* are driven by the scan driver 3, to respectively apply write pulses to the plurality of scan electrodes 12 in the PDP 1 in order while shifting shift pulses SH in a vertical scanning direction in the writing time period. Thus, address discharges are induced in the corresponding discharge cell DC.

The plurality of scan driver ICs 3*a* respectively apply periodical sustain pulses to the plurality of scan electrodes 12 in the PDP 1 in a sustain time period. On the other hand, the sustain driver 4 simultaneously applies a sustain pulse whose phase is shifted by 180 degrees from that of the sustain pulses applied to the scan electrodes 12 to the plurality of sustain electrodes 13 in the PDP 1. This causes sustain discharges to be induced in the corresponding discharge cell DC.

(1-2) Driving Voltage in PDP 1

Figure 2:
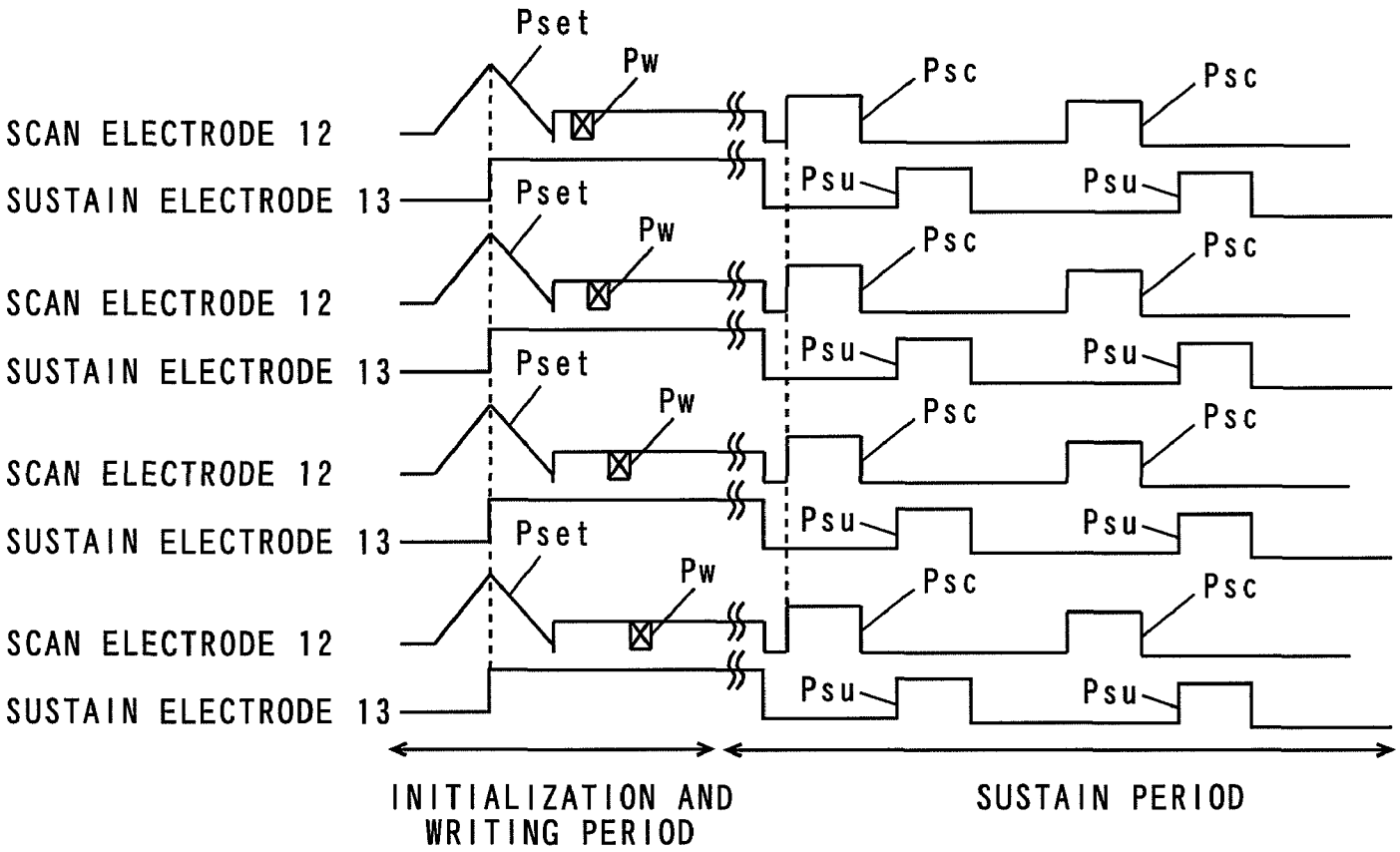
FIG. 2 is a timing chart showing an example of driving voltages respectively applied to a scan electrode and a sustain electrode in a PDP shown in FIG. 1.

FIG. 2 is a timing chart showing an example of driving voltages respectively applied to the scan electrodes 12 and the sustain electrodes 13 in the PDP 1 shown in FIG. 1.

In an initialization and writing time period, initialization pulses (setup pulses) Pset are simultaneously applied, respectively, to the plurality of scan electrodes 12. Therefore, write pulses Pw are sequentially applied, respectively, to the plurality of scan electrodes 12. This causes address discharges to be induced in the corresponding discharge cell DC in the PDP 1.

In a sustain time period, sustain pulses Psc are then periodically applied, respectively, to the plurality of scan electrodes 12, and sustain pulses Psu are periodically applied, respectively, to the plurality of sustain electrodes 13. The phase of the sustain pulse Psu is shifted by 180 degrees from the phase of the sustain pulse Psc. This causes sustain discharges to be induced subsequently to the address discharges.

(1-3) Configuration of Sustain Driver 4

Figure 3:
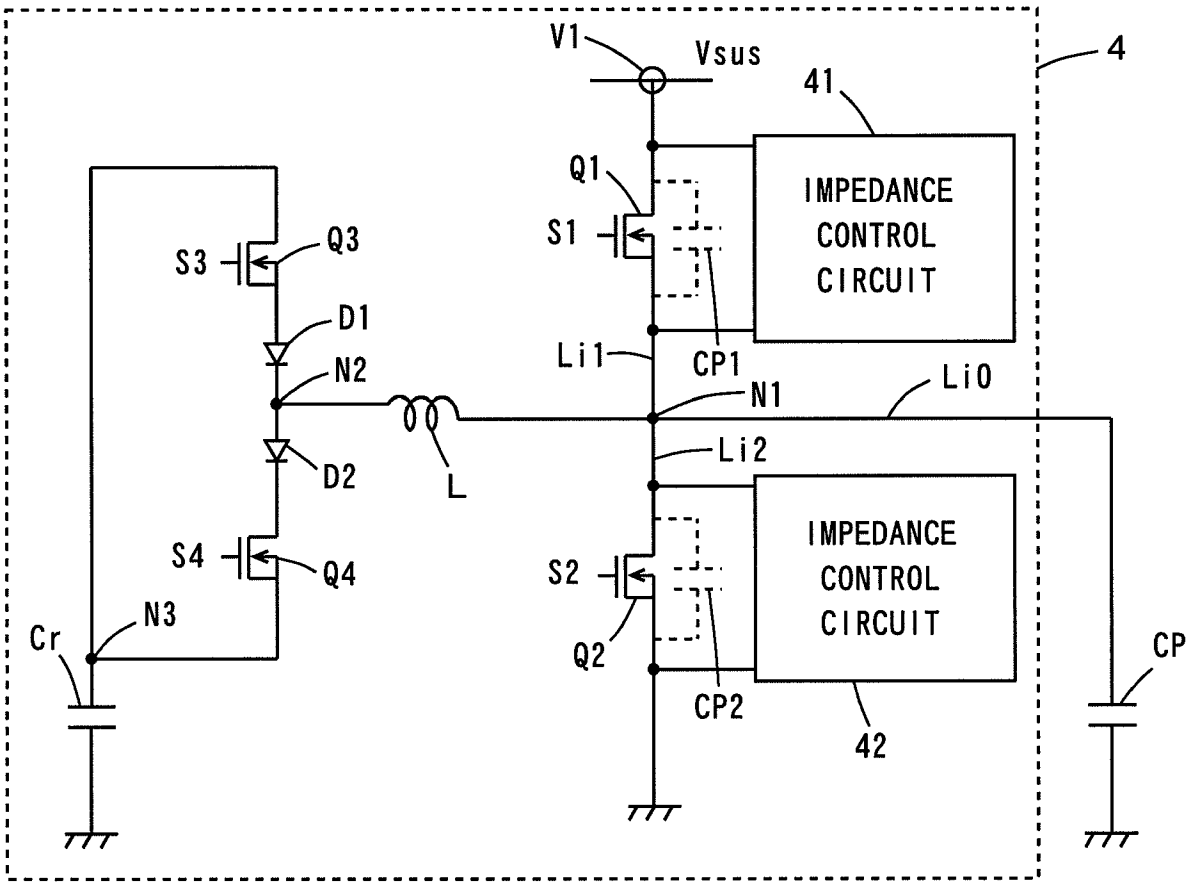
FIG. 3 is a circuit diagram showing the configuration of the sustain driver shown in FIG. 1.

The sustain driver 4 shown in FIG. 1 will be then described. FIG. 3 is a circuit diagram showing the configuration of the sustain driver 4 shown in FIG. 1.

The sustain driver 4 shown in FIG. 3 includes n-channel field effect transistors (herein after abbreviated as transistors) Q1 to Q4 serving as switching elements, impedance control circuits 41 and 42, a recovery capacitor Cr, a recovery coil L, and diodes D1 and D2. The respective configurations of the impedance control circuits 41 and 42 will be described later.

The transistor Q1 has its one end connected to a power supply terminal V1 and the other end connected to a node N1 through an interconnection Li1, and has its gate receiving a control signal S1. The transistor Q1 has a drain-source capacitance CP1 as a parasitic capacitance. An impedance control circuit 41 is connected in parallel with the transistor Q1 between the drain and the source of the transistor Q1. A power supply voltage Vsus is applied to the power supply terminal V1.

The transistor Q2 has its one end connected to the node N1 through an interconnection Li2 and the other end connected to a ground terminal, and has its gate receiving a control signal S2. The transistor Q2 has a drain-source capacitance CP2 as a parasitic capacitance. The impedance control circuit 42 is connected in parallel with the transistor Q2 between the drain and the source of the transistor Q2.

The node N1 is connected to 480 sustain electrodes 13, for example, through an interconnection Li0. In FIG. 3, a panel capacitance Cp corresponding to the total capacitance between the plurality of sustain electrodes 13 and the ground terminal is shown.

The recovery capacitor Cr is connected between a node N3 and the ground terminal. The transistors Q3 and the diode D1 are connected in series between the node N3 and a node N2. The diode D2 and the transistor Q4 are connected in series between the node N2 and the node N3. A control signal S3 is inputted to the gate of the transistor Q3, and a control signal S4 is inputted to the gate of the transistor Q4. The recovery coil L is connected between the node N2 and the node N1.

(1-4) Operation of Sustain Driver 4

Figure 4:
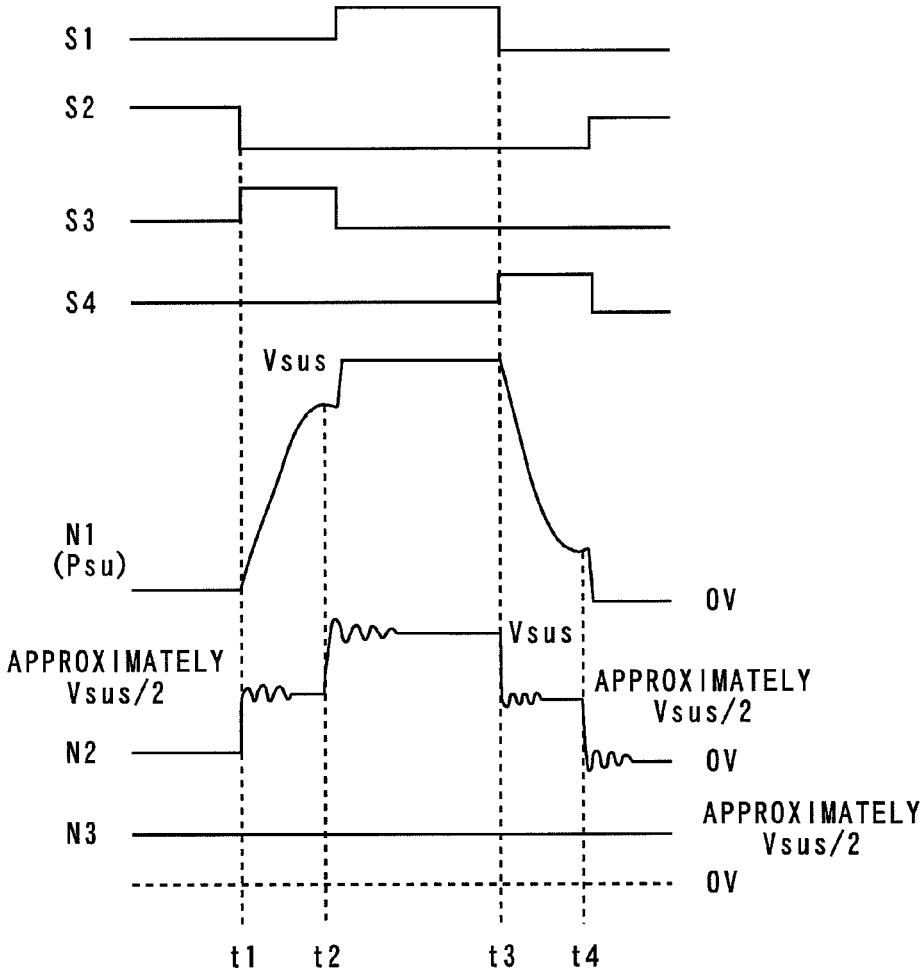
FIG. 4 is a timing chart for explaining the operation in a sustain time period of the sustain driver.

The operation in the sustain time period of the sustain driver 4 configured as described above will be then described. FIG. 4 is a timing chart for explaining the operation in the sustain time period of the sustain driver 4. FIG. 4 shows the control signals S1 to S4 respectively inputted to the transistors Q1 to Q4 and the respective voltages of the nodes N1 to N3.

First, at the time t1, the control signal S2 enters a low level to turn the transistor Q2 off, and the control signals S3 enters a high level to turn the transistor Q3 on. At this time, the control signal S1 enters a low level to turn the transistor Q1 off, and the control signal S4 enters a low level to turn the transistor Q4 off. Consequently, the recovery capacitor Cr is connected to the recovery coil L through the transistor Q3 and the diode D1. A potential at the node N1 smoothly rises due to LC resonance caused by the recovery coil L and the panel capacitance Cp. At this time, charges in the recovery capacitor Cr are emitted into the panel capacitance Cp through the transistor Q3, the diode D1, and the recovery coil L.

Furthermore, a current flowing through the transistor Q3, the diode D1, and the recover coil L flows not only into the panel capacitance Cp but also into the drain-source capacitance CP1 of the transistor Q1 and the impedance control circuit 41 through the interconnection Li1 and into the drain-source capacitance CP2 of the transistor Q2 and the impedance control circuit 42 through the interconnection Li2.

Then, at the time t2, the control signal S1 enters a high level to turn the transistor Q1 on, and the control signal S3 enters a low level to turn the transistor Q3 off. Consequently, the node N1 is connected to the power supply terminal V1, so that the potential at the node N1 rapidly rises and is fixed to a power supply voltage Vsus. At this time, a switching noise having a plurality of frequency components is generated from the transistor Q1. The switching noise includes a frequency component of LC resonance caused by the drain-source capacitance CP1 of the transistor Q1 and an inductance component of the interconnection Li1 and the other plurality of frequency components.

At this time, the switching noise generated from the transistor Q1 is returned to the power supply terminal V1 through the capacitor CP1 and the impedance control circuit 41 and is returned to the ground terminal through the capacitor CP2 and the impedance control circuit 42. Thus, the effect of the switching noise on the sustain electrode 13 is reduced, so that undesired radiation is restrained. The respective operations of the impedance control circuits 41 and 42 will be described later.

Then, at the time t3, the control signal S1 enters a low level to turn the transistor Q1 off, and the control signal S4 enters a high level to turn the transistor Q4 on. Consequently, the recovery capacitor Cr is connected to the recovery coil L through the diode D2 and the transistor Q4. The potential at the node N1 gently falls due to LC resonance caused by the recovery coil L and the panel capacitance Cp. At this time, charges stored in the panel capacitance Cp are stored in the recovery capacitor Cr through the recovery coil L, the diode D2, and the transistor Q4, to recover the charges.

Then, at the time t4, the control signal S2 enters a high level to turn the transistor Q2 on, and the control signal S4 enters a low level to turn the transistor Q4 off. Consequently, the node N1 is connected to the ground terminal, so that the potential at the node N1 rapidly rises and is fixed to the ground potential. At this time, a switching noise having a plurality of frequency components is generated from the transistor Q2. The switching noise includes a frequency component of LC resonance caused by the drain-source capacitance CP2 of the transistor Q2 and an inductance component of the interconnection Li2 and the other plurality of frequency components.

At this time, the switching noise generated from the transistor Q2 is returned to the power supply terminal V1 through the capacitor CP1 and the impedance control circuit 41 and is returned to the ground terminal through the capacitor CP2 and the impedance control circuit 42. Thus, the effect of the switching noise on the sustain electrode 13 is reduced, so that undesired radiation is restrained. The respective operations of the impedance control circuits 41 and 42 will be described later.

The above-mentioned operation is repeatedly performed in the sustain time period. In this case, the switching noises in a wide band respectively generated from the transistors Q1 and Q2 are restrained by the functions of the impedance control circuits 41 and 42. As a result, the undesired radiation of an electromagnetic wave over a wide band is restrained.

In the present embodiment, any of the first to third configurations, described below, is used as the impedance control circuits 41 and 42.

(1-5) First Example of Respective Configurations of Impedance Control Circuits 41 and 42

Figure 5:
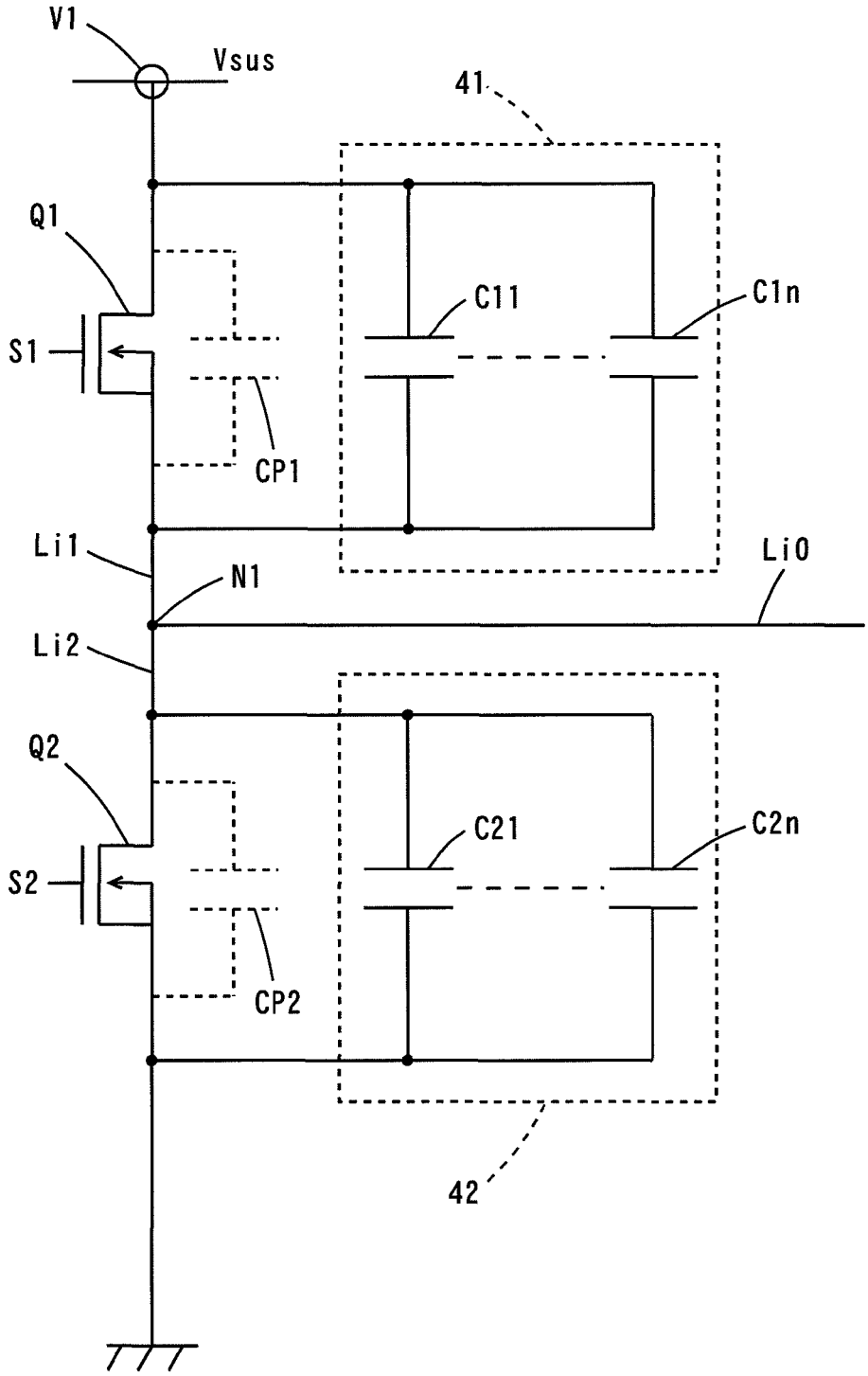
FIG. 5 is a circuit diagram showing a first example of the configuration of an impedance control circuit.

FIG. 5 is a circuit diagram showing a first example of the respective configurations of the impedance control circuits 41 and 42.

As shown in FIG. 5, the impedance control circuit 41 includes n capacitors C11 to C1*n*. n is a natural number of not less than two. The capacitors C11 to C1*n* are connected in parallel with the transistor Q1. It is preferable that respective nodes between the capacitors C11 to C1*n* and the transistor Q1 are closer to the source and the drain of the transistor Q1. For example, it is preferable that the capacitors C11 to C1*n* and the transistor Q1 are connected to each other on the same circuit board. This allows the effect, descried later, to be more reliably obtained. The capacitors C11 to C1*n* respectively have different capacitance values. Here, the respective capacitance values of the capacitors C11 to C1*n* decrease in this order, and the capacitor C1*n* has the smallest capacitance value.

The impedance control circuit 42 includes n capacitors C21 and C2*n*. n is a natural number of not less than two. The capacitors C21 to C2*n* are connected in parallel with the transistor Q2. It is preferable that respective nodes between the capacitors C21 to C2*n* and the transistor Q2 are closer to the source and the drain of the transistor Q2. For example, it is preferable that the capacitors C21 to C2*n* and the transistor Q2 are connected to each other on the same circuit board. This allows the effect, descried later, to be more reliably obtained. The capacitors C21 to C2*n* respectively have different capacitance values. Here, the respective capacitance values of the capacitors C21 to C2*n* decrease in this order, and the capacitor C2*n* has the smallest capacitance value.

In the present embodiment, each of the capacitors C11 to C1*n* and C21 and C2*n* is composed of a stacked ceramic capacitor.

Figure 6:
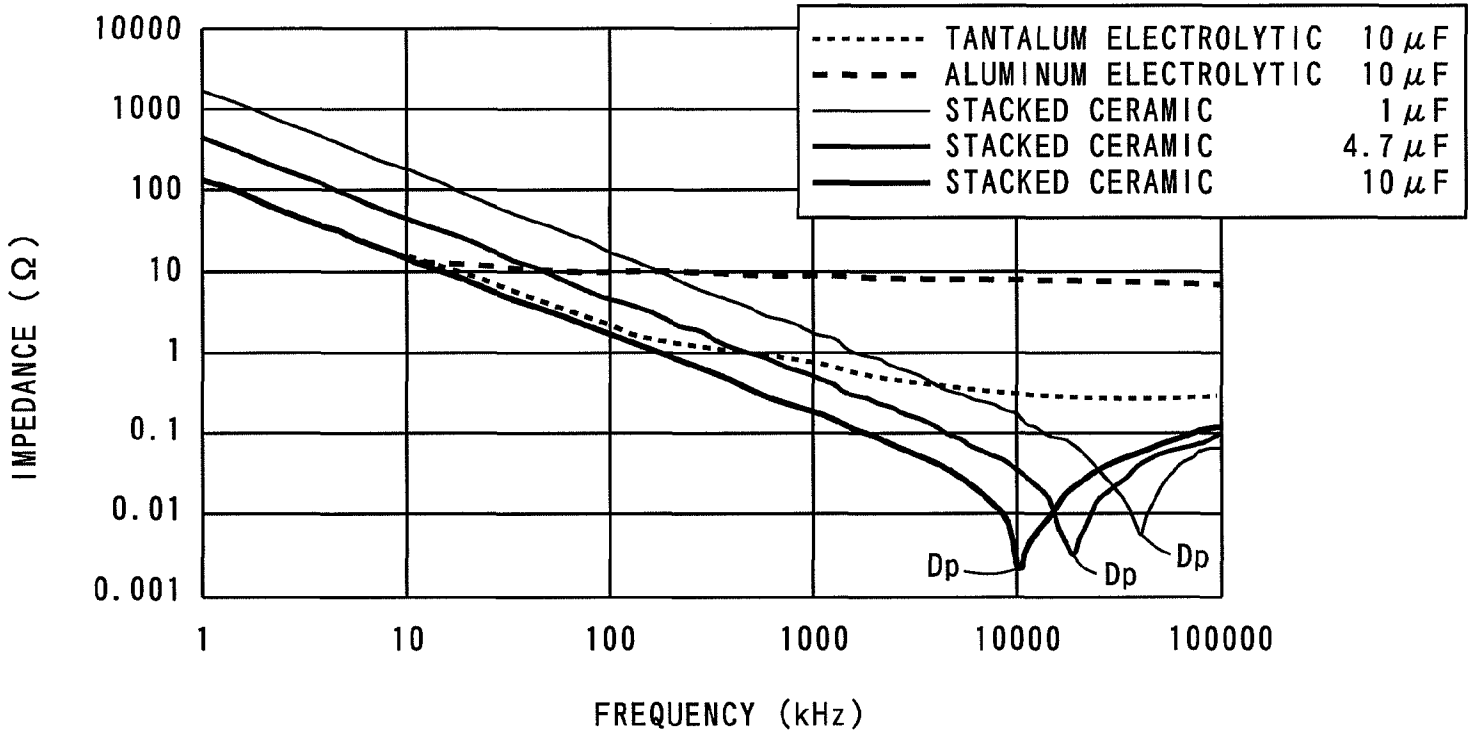
FIG. 6 is a diagram showing respective impedance characteristics of a stacked ceramic capacitor, a tantalum electrolytic capacitor, and an aluminum electrolytic capacitor.

FIG. 6 is a diagram showing respective impedance characteristics of the stacked ceramic capacitors, a tantalum electrolytic capacitor, and an aluminum electrolytic capacitor.

FIG. 6 shows the relationship between the impedance and the frequency of each of a tantalum electrolytic capacitor having a capacitance value of 10 μF, an aluminum electrolytic capacitor having a capacitance value of 10 μF, and stacked ceramic capacitors respectively having capacitance values of 1 μF, 4.7 μF, and 10 μF. The vertical axis indicates impedance, and the horizontal axis indicates frequency.

In the stacked ceramic capacitor, a dip (a minimal portion) Dp occurs in the impedance characteristics. The frequency of the dip Dp corresponds to a self-resonance frequency. The self-resonance frequency of the stacked ceramic capacitor differs depending on the capacitance value. On the other hand, no dip occurs in the impedance characteristics in the tantalum electrolytic capacitor and the aluminum electrolytic capacitor.

In the impedance control circuit 41 shown in FIG. 5, the n capacitors C1 to C1*n* respectively having different capacitance values are connected in parallel with the transistor Q1. Therefore, the switching noise is absorbed in the power supply terminal V1 in the n different self-resonance frequency bands.

Similarly, in the impedance control circuit 42, the n capacitors C21 to C2*n* respectively having different capacitance values are connected in parallel with the transistor Q2. Therefore, the switching noise is absorbed in the ground terminal in the n different self-resonance frequency bands.

Since the transistors Q1 and Q2 respectively generate the switching noises, the capacitors C11 to C1*n* are arranged in the vicinity of the transistor Q1, and the capacitors C21 to C2*n* are arranged in the vicinity of the capacitors C21 to C2*n* transistor Q2 in order to reduce the effect of the interconnections Li1 and Li2. This allows the effect of the interconnections L11 and Li2 to be removed. Consequently, the switching noises respectively generated from the transistors Q1 and Q2 can be sufficiently absorbed, as compared with those in a case where the capacitors are inserted between the interconnection Li0 and the ground terminal shown in FIG. 3.

Here, the respective functions of the impedance control circuits 41 and 42 shown in FIG. 5 will be described using FIGS. 7 and 8.

Figure 7:
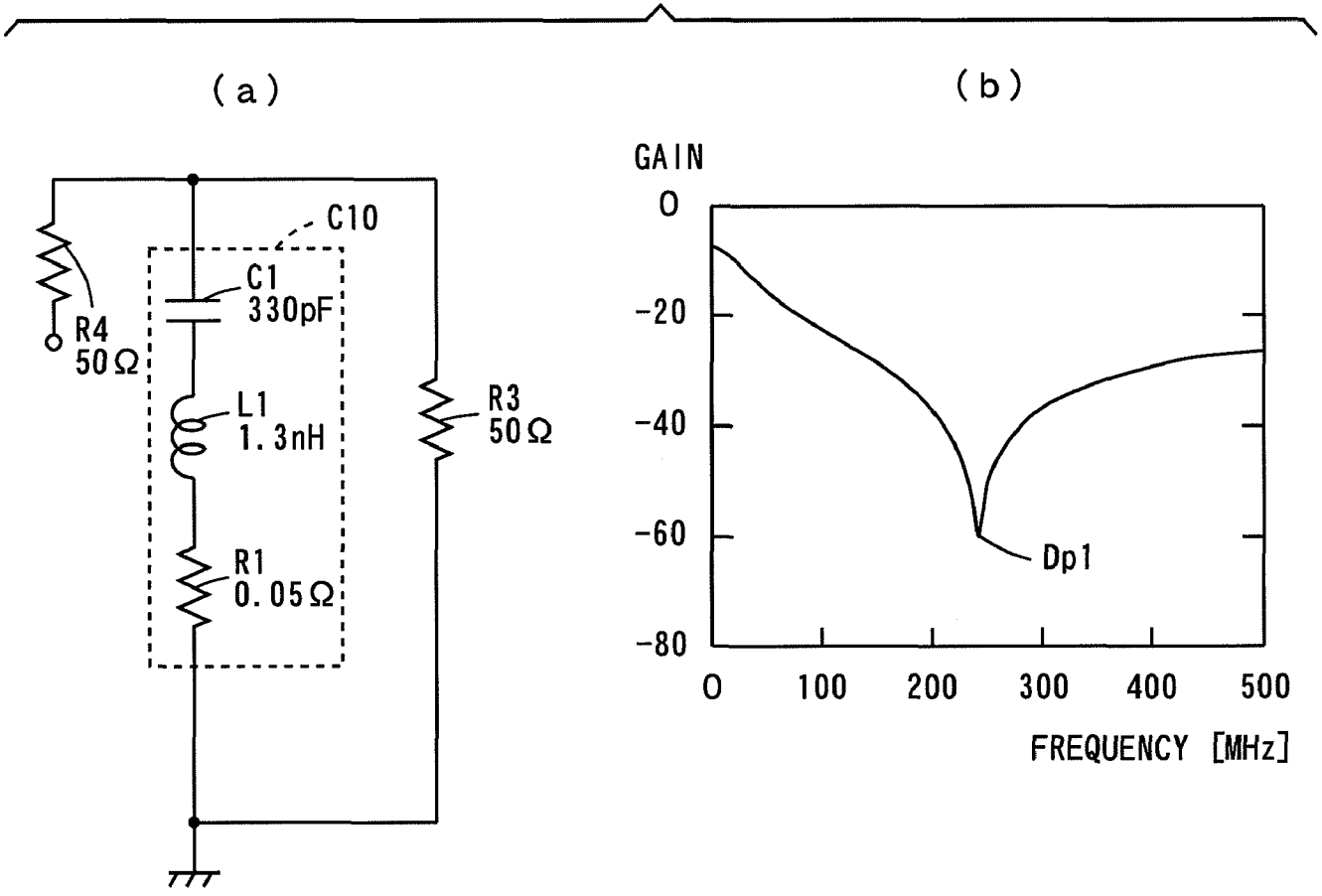
FIG. 7 (*a*) is a diagram showing an internal equivalent circuit of one stacked ceramic capacitor, and FIG. 7 (*b*) is a diagram showing the results of calculation of impedance characteristics of one stacked ceramic capacitor.

FIG. 7 (*a*) is a diagram showing an internal equivalent circuit of the one stacked ceramic capacitor, and FIG. 7 (*b*) is a diagram showing the results of calculation of the impedance characteristics of the one stacked ceramic capacitor. In FIG. 7 (*b*), the horizontal axis indicates frequency, and the vertical axis indicates gain.

In FIG. 7 (*a*), the stacked ceramic capacitor C10 has a capacitance component C1, an inductance component L1, and a resistance component R1. In this example, the value of the capacitance component C1 is 330 pF, the value of the inductance component L1 is 1.3 nH, and the value of the resistance component R1 is 0.05Ω. Here, the impedance characteristics of the stacked ceramic capacitor C10 in a 50Ω measuring system are found by calculation. Both the respective values of resistance components R3 and R4 in the 50Ω measuring system are 50Ω.

In the stacked ceramic capacitor C10, when the area of a ceramic layer is constant, the value of the capacitance component C1 increases as the number of ceramic layers increases, so that the value of the inductance component L1 and the value of the resistance component R1 hardly change. Since the value of the resistance component R1 is low, a dip Dp1 occurs in the impedance characteristics, as shown in FIG. 7 (*b*). As described above, the frequency of the dip Dp1 corresponds to a self-resonance frequency. The self-resonance frequency differs depending on the value of the capacitance component C1.

Since the internal equivalent circuit of the stacked ceramic capacitor C10 is a series circuit in LCR (Inductance-Capacitance-Resistance), the self-resonance frequency exists. In the example shown in FIG. 7 (*b*), the self-resonance frequency is approximately 250 MHz, and the impedance in the self-resonance frequency is the lowest.

On the other hand, in the tantalum electrolytic capacitor or the aluminum electrolytic capacitor, a tantalum sheet or an aluminum sheet is wound, so that a resistance component is large. Thus, no dip occurs in the impedance characteristics, as shown in FIG. 6.

In order to thus generate sufficient self-resonance, it is preferable that a stacked ceramic capacitor having a definite dip in its impedance characteristics is used. Although the effect of the self-resonance in the tantalum electrolytic capacitor or the aluminum electrolytic capacitor is lower than that in the stacked ceramic capacitor, self-resonance can be generated.

Figure 8:
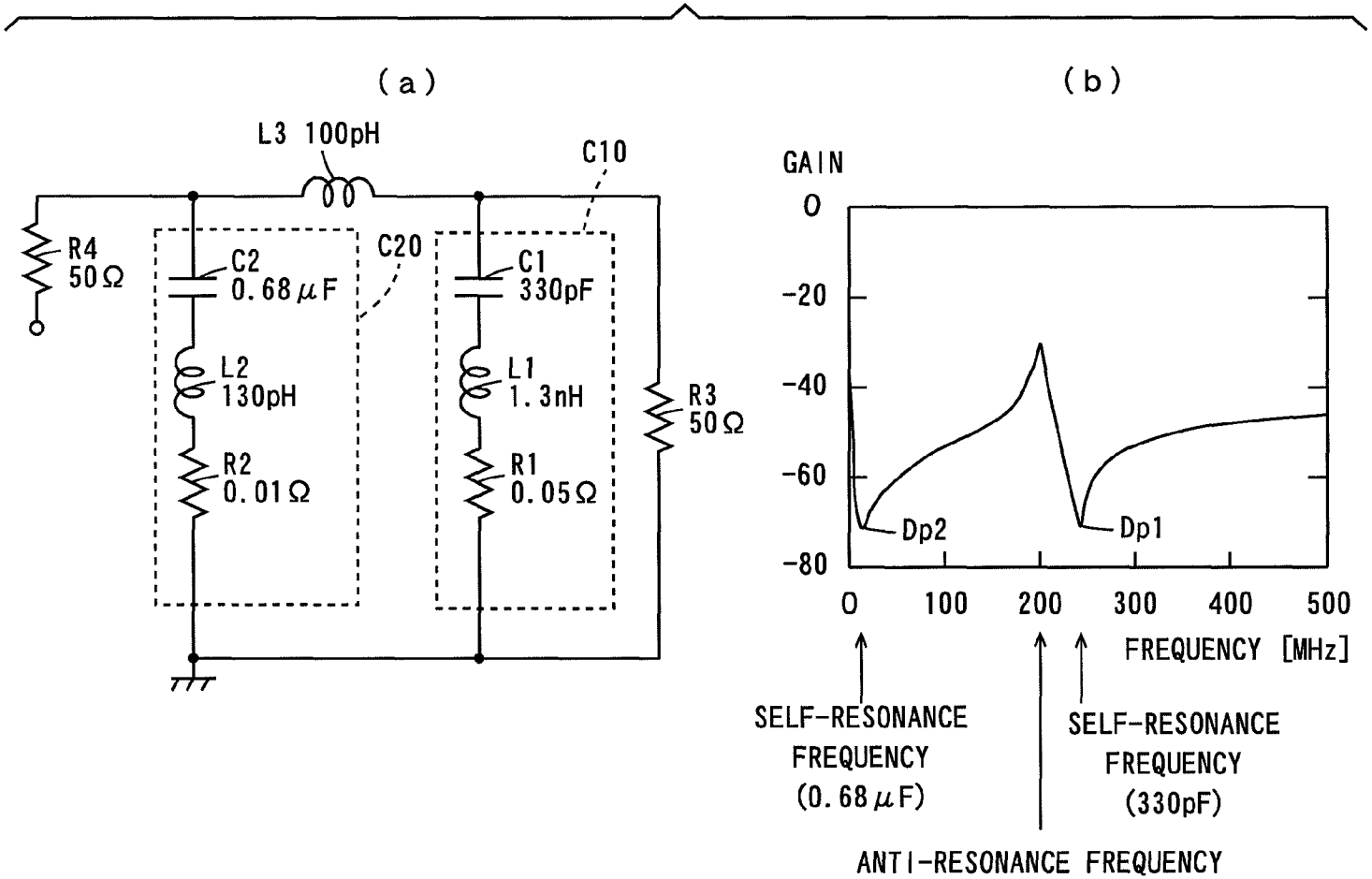
FIG. 8 (*a*) is a diagram showing an internal equivalent circuit of a parallel circuit of two stacked ceramic capacitors, and FIG. 8 (*b*) is a diagram showing the results of calculation of impedance characteristics of a parallel circuit of two stacked ceramic capacitors.

FIG. 8 (*a*) is a diagram showing an internal equivalent circuit of a parallel circuit of two stacked ceramic capacitors, and FIG. 8 (*b*) is a diagram showing the results of calculation of the impedance characteristics of the parallel circuit of the two stacked ceramic capacitors.

In FIG. 8 (*a*), the internal equivalent circuit of the stacked ceramic capacitor C10 is the same as the stacked ceramic capacitor C10 shown in FIG. 7 (*a*). The stacked ceramic capacitor C20 has a capacitance component C2, an inductance component L2, and a resistance component R2. In this example, the value of the capacitance component C2 is 0.68 μF, the value of the inductance component L2 is 130 pH, and the value of the resistance component is 0.01Ω. The value of an inductance component L3 of an interconnection pattern for connecting the two stacked ceramic capacitors C10 and C20 is 100 pH.

In the impedance characteristics shown in FIG. 8 (*b*), there occur a dip Dp1 caused by the stacked ceramic capacitor C1 having a small capacitance component C1 (330 pF) and a dip Dp2 caused by the stacked ceramic capacitor C20 having a large capacitance value (0.68 μF). The frequency of the dip Dp1 corresponds to the self-resonance frequency of the stacked ceramic capacitor C10, and the frequency of the dip Dp2 corresponds to the self-resonance frequency of the stacked ceramic capacitor C20.

When the stacked ceramic capacitor C20 having a large capacitance value (0.68 μF) is individually used, the impedance characteristics in a low band can be improved, as compared with those in a case where the stacked ceramic capacitor C10 having a small capacitance component C1 (330 pH) is individually used. In a band higher than a self-resonance frequency of 0.68 μF, however, the impedance characteristics are degraded due to the effect of the inductance component L2 in the stacked ceramic capacitor C20.

As shown in FIG. 8, when the stacked ceramic capacitors C10 and C20 are used, anti-resonance occurs at a frequency intermediate between both the self-resonance frequencies, so that the impedance characteristics are degraded. In the example shown in FIG. 8, the impedance characteristics are degraded in a frequency band including 200 MHz.

Figure 9:
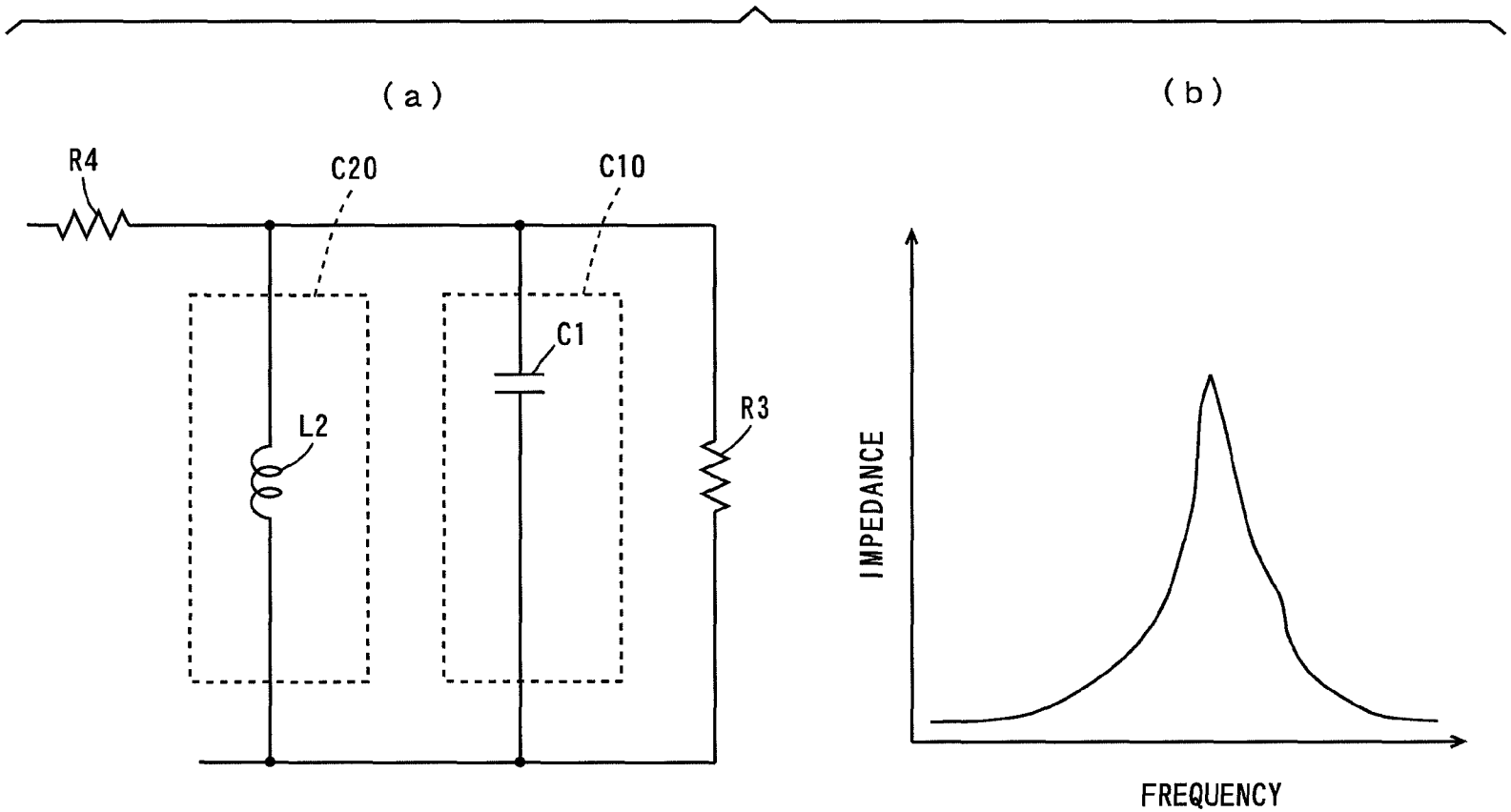
FIG. 9 is a diagram for explaining anti-resonance in a parallel circuit of two stacked ceramic capacitors.

FIG. 9 is a diagram for explaining anti-resonance in the parallel circuit of the two stacked ceramic capacitors. FIG. 9 (*a*) is a diagram showing an internal equivalent circuit in a case where anti-resonance occurs, and FIG. 9 (*b*) is a diagram showing impedance characteristics in a case where anti-resonance occurs.

The impedance of the capacitance component C2 in the stacked ceramic capacitor C20 shown in FIG. 8 (*a*) is $1/(2\pi f\times 0.68\ [\mu F])$. Here, f is frequency. Thus, the impedance of the capacitance component C2 is 0.234Ω at a frequency of 1 MHz, 0.0234Ω at a frequency of 4-0 100 MHz, and 0.00234 n at a frequency of 10 MHz, and the capacitance component C2 enters a short state at a high frequency.

On the other hand, the value of the capacitance component C1 in the stacked ceramic capacitor C10 is lower than the value of the capacitance component C2 in the stacked ceramic capacitor C20. Therefore, the impedance of the capacitance component C1 is higher than the impedance of the capacitance component C2. Further, the impedance of the inductance component L2 in the stacked ceramic capacitor C20 increases when the frequency increases. On the other hand, the impedance of the inductance component L1 in the stacked ceramic capacitor C10 is lower than the impedance of the capacitance component C1 therein.

At a high frequency, therefore, an equivalent circuit of the parallel circuit of the two stacked ceramic capacitors C10 and C20 is an LC parallel resonance circuit shown in FIG. 9 (*a*).

In this case, the impedance of the LC parallel resonance circuit increases in a resonance portion, so that anti-resonance occurs, as shown in FIG. 9 (*b*). In the example shown in FIG. 8 (*b*), anti-resonance occurs in the frequency band including 200 MHz.

In the impedance control circuits 41 and 42 shown in FIG. 5, the respective capacitance values of the capacitors C11 to C1*n* and the capacitors C21 to C2*n* are set such that a plurality of peak frequencies in the switching noises respectively generated by the transistors Q1 and Q2 are not positioned within an anti-resonance frequency band.

Thus, the switching noises each having a plurality of frequency components generated from the transistors Q1 and Q2 are respectively restrained by the functions of the impedance control circuits 41 and 42. As a result, the undesired radiation of the electromagnetic wave over a wide band is sufficiently restrained.

(1-6) Second Example of Respective Configurations of Impedance Control Circuits 41 and 42

Figure 10:
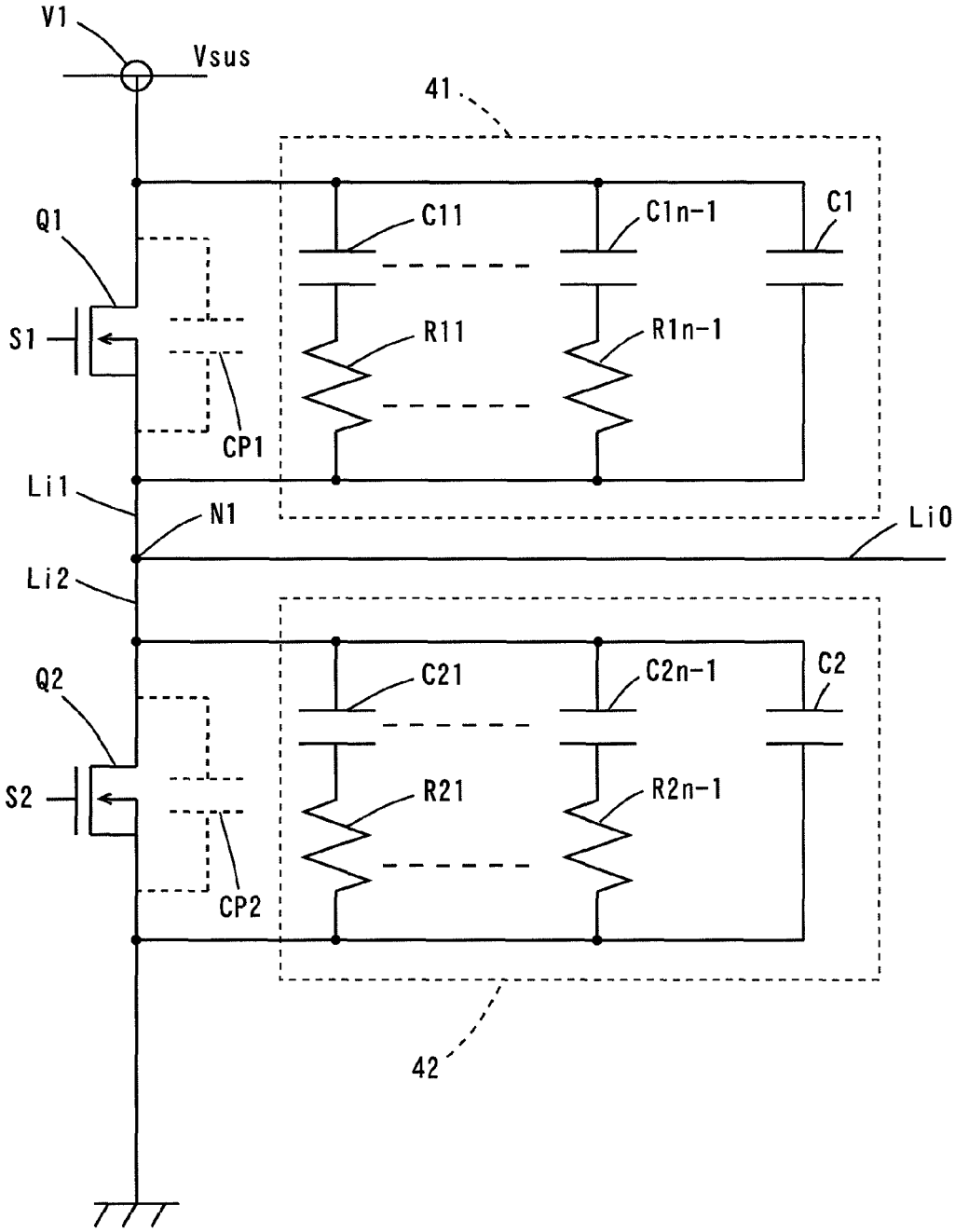
FIG. 10 is a circuit diagram showing a second example of the configuration of an impedance control circuit.

FIG. 10 is a circuit diagram showing a second example of the respective configurations of the impedance control circuits 41 and 42.

The impedance control circuits 41 and 42 shown in FIG. 10 differ from the impedance control circuits 41 and 42 shown in FIG. 5 in the following points. Resistive elements R11 to R1*n*−1 are respectively connected in series with capacitors C11 to C1*n*−1 in the impedance control circuit 41. The respective capacitance values of the capacitors C11 to C1*n* decrease in this order, and the capacitor C1*n* has the smallest capacitance value. No resistive element is connected to the capacitor C1*n* having the smallest capacitance value in the impedance control circuit 41. The respective resistance values of the resistive elements R11 to R1*n*−1 decrease in this order, and the resistive element R1*n*−1 has the smallest resistance value.

Similarly, resistive elements R21 to R2*n*−1 are respectively connected in series with capacitors C21 to C2*n*−1 in the impedance control circuit 42. The respective capacitance values of the capacitors C21 to C2*n* decrease in this order, and the capacitor C2*n* has the smallest capacitance value. No resistive element is connected to the capacitor C2*n* having the smallest capacitance value in the impedance control circuit 42. The respective resistance values of the resistive elements R21 to R2*n*−1 decrease in this order, and the resistive element R2*n*−1 has the smallest resistance value.

The respective configurations of the impedance control circuits 41 and 42 shown in FIG. 10 are the same as those of the impedance control circuits 41 and 42 shown in FIG. 5 except for the foregoing points. Therefore, the same units are assigned the same reference numerals and hence, the detailed description is omitted.

As described using FIG. 8, in a simple parallel circuit of a plurality of stacked ceramic capacitors, impedance characteristics are degraded at an anti-resonance frequency. In the example shown in FIG. 10, therefore, the impedance characteristics are inhibited from being degraded at an anti-resonance frequency by adding resistive elements. Here, the respective functions of the impedance control circuits 41 and 42 shown in FIG. 10 will be described using FIG. 11.

Figure 11:
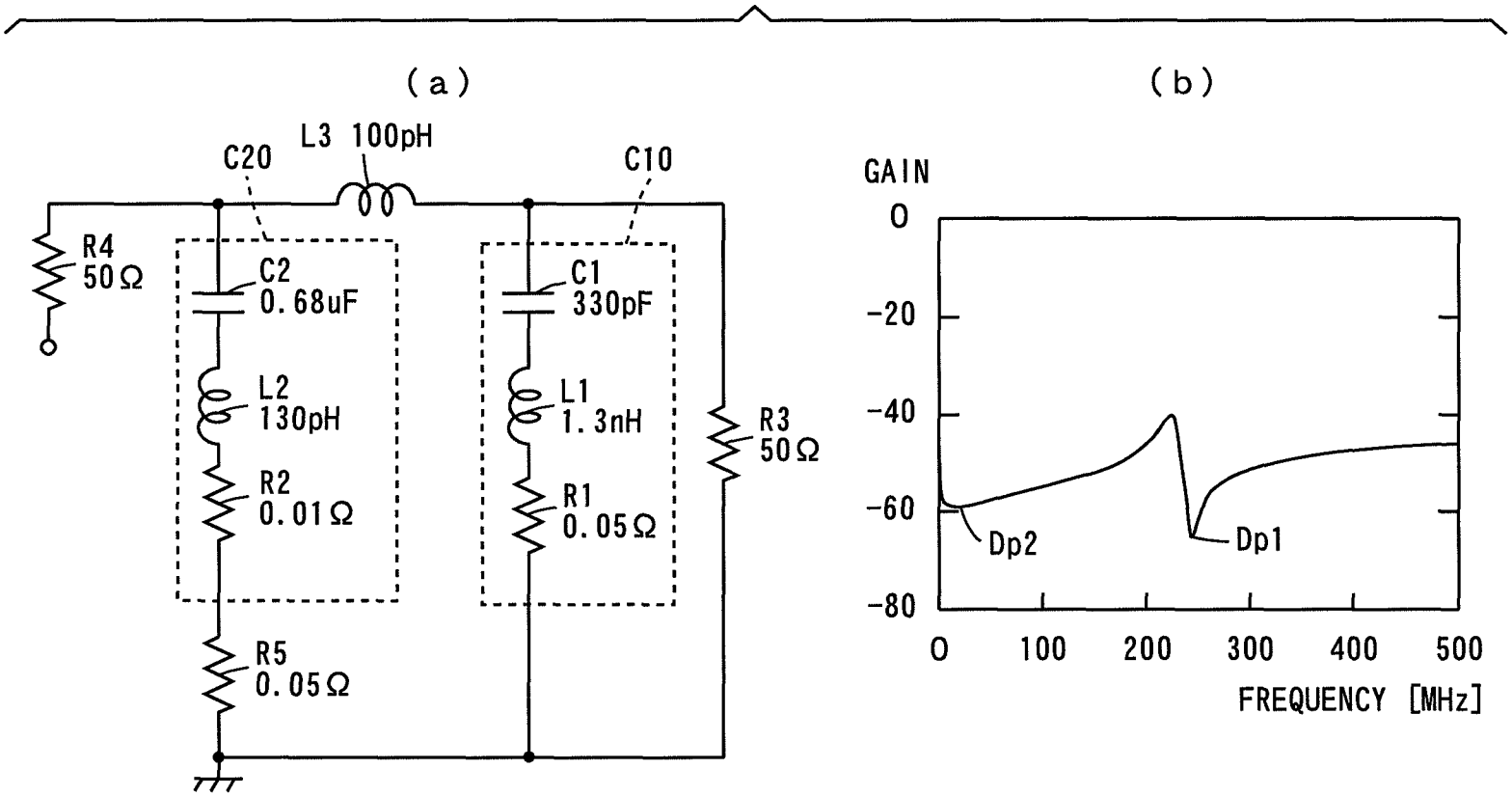
FIG. 11 (*a*) is a diagram showing an internal equivalent circuit of a parallel circuit of two stacked ceramic capacitors, and FIG. 11 (*b*) is a diagram showing the results of calculation of impedance characteristics of the parallel circuit of the two stacked ceramic capacitors.

FIG. 11 (*a*) is a diagram showing an internal equivalent circuit of two stacked ceramic capacitors, and FIG. 11 (*b*) is a diagram showing the results of calculation of the impedance characteristics of the parallel circuit of the two stacked ceramic capacitors. In FIG. 11 (*b*), the vertical axis indicates frequency, and the horizontal axis indicates gain.

In FIG. 11 (*a*), the internal equivalent circuit of the stacked ceramic capacitors C10 and C20 is the same as that of the stacked ceramic capacitors C10 and C20 shown in FIG. 8 (*a*).

In FIG. 11, a resistive element R5 is inserted in series with the stacked ceramic capacitor C20 having a large capacitance value (0.68 μF). In this example, the value of the resistive element R5 is 0.05Ω. In this case, although impedance characteristics at a self-resonance frequency (a dip Dp2) caused by the stacked ceramic capacitor C20 are degraded, the impedance characteristics are inhibited from being degraded by anti-resonance occurring at a frequency intermediate between the self-resonance frequency of the stacked ceramic capacitor C10 having a small capacitance value (330 pF) and the self-resonance frequency of the stacked ceramic capacitor C20.

The resistive element R5 is thus inserted in series with the stacked ceramic capacitor C20 so that the impedance characteristics are improved over a wide band.

In the impedance control circuits 41 and 42 shown in FIG. 10, the switching noises each having a plurality of frequencies respectively generated from the transistors Q1 and Q2 over a wide band are restrained. As a result, the undesired radiation of the electromagnetic wave over a wide band is sufficiently restrained.

(1-7) Third Example of Respective Configurations of Impedance Control Circuits 41 and 42

Figure 12:
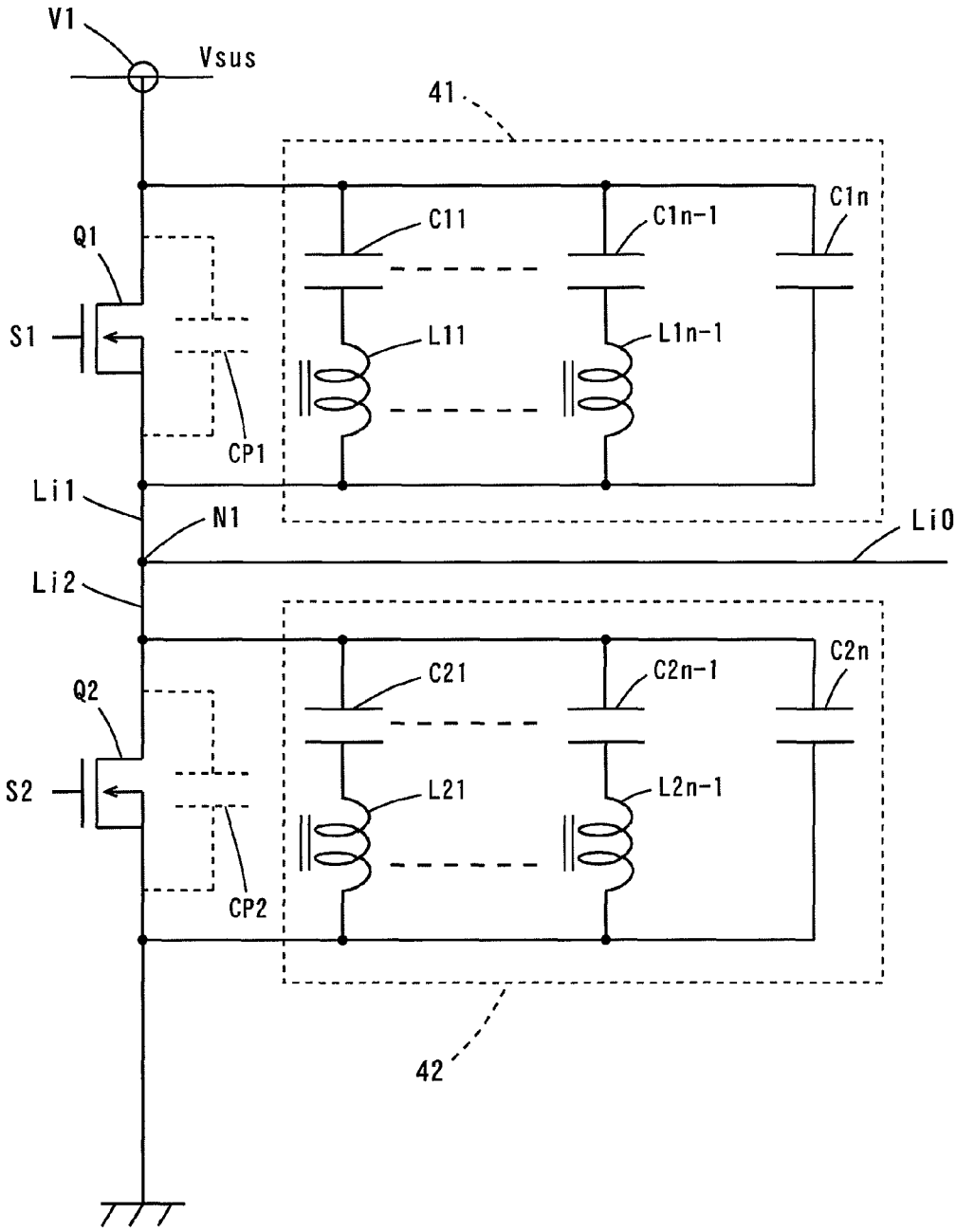
FIG. 12 is a circuit diagram showing a third example of the configuration of an impedance control circuit.

FIG. 12 is a circuit diagram showing a third example of the respective configurations of the impedance control circuits 41 and 42.

The impedance control circuits 41 and 42 shown in FIG. 12 differ from the impedance control circuits 41 and 42 shown in FIG. 5 in the following points. Beads cores L11 to L1*n*−1 are respectively connected in series with capacitors C11 to C1*n*−1 in the impedance control circuit 41. The respective capacitance values of the capacitors C11 to C1*n* decrease in this order, and the capacitor C1*n* has the smallest capacitance value. No beads core is connected to the capacitor C1*n* having the smallest capacitance value in the impedance control circuit 41.

Similarly, beads cores L21 to L2*n*−1 are respectively connected in series with capacitors C21 to C2*n* in the impedance control circuit 42. The respective capacitance values of the capacitors C11 to C1*n* decrease in this order, and the capacitor C1*n* has the smallest capacitance value. No bead score is connected to the capacitor C2*n* having the smallest capacitance value in the impedance control circuit 42.

The respective configurations of the impedance control circuits 41 and 42 shown in FIG. 12 are the same as those of the impedance control circuits 41 and 42 shown in FIG. 5 except for the foregoing points. Therefore, the same units are assigned the same reference numerals and hence, the detailed description is omitted.

In the example shown in FIG. 12, impedance characteristics are inhibited from being degraded at an anti-resonance frequency by adding beads cores. Here, the respective functions of the impedance control circuits 41 and 42 shown in FIG. 12 will be described using FIG. 13.

Figure 13:
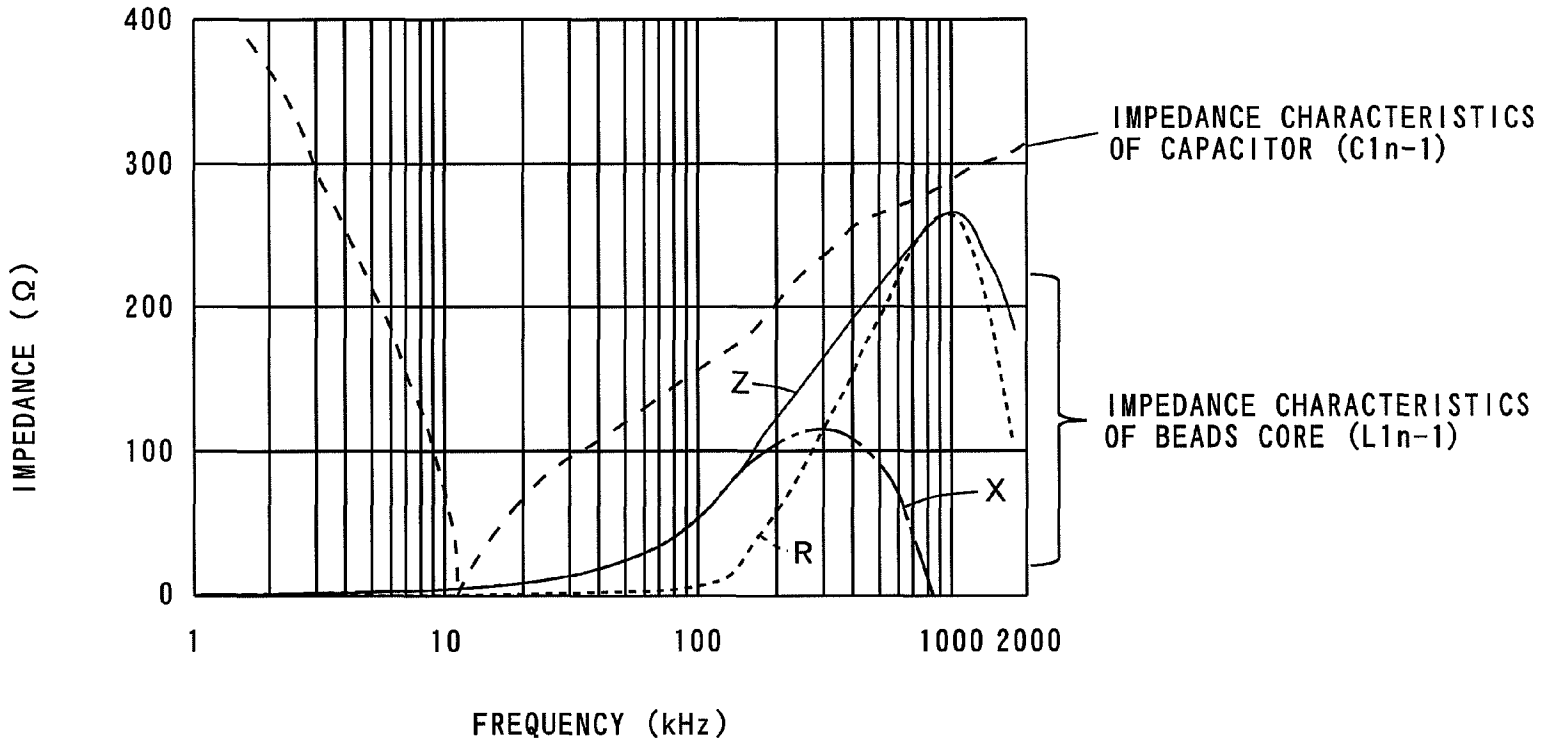
FIG. 13 is a diagram showing respective impedance characteristics of a stacked ceramic capacitor and a beads core.

FIG. 13 is a diagram showing respective impedance characteristics of the stacked ceramic capacitor and the beads core. In FIG. 13, the vertical axis indicates frequency, and the horizontal axis indicates impedance.

In FIG. 13, the impedance characteristics of the capacitor C1*n*−1 are indicated by a broken line. Further, the impedance characteristics of the beads core L1*n*−1 are indicated by a solid line. A resistance component R is indicated by a dotted line, and a reactance component X is indicated by a one-dot and dash line.

As shown in FIG. 13, constants (the resistance component R and the reactance component X) are selected such that the impedance characteristics of the beads core L1*n*−1 rise in a frequency region exceeding the self-resonance frequency of the capacitor C1*n*−1.

In the impedance control circuit 41 shown in FIG. 12, therefore, the impedance characteristics are inhibited from being degraded by anti-resonance at a frequency higher than the self-resonance frequency of the capacitor C1*n*−1. That is, at the frequency higher than the self-resonance frequency of the capacitor C1*n*−1, the same effect as that in a case where the resistive elements R11 to R1*n*−1 shown in FIG. 10 are inserted in series with the capacitors C11 to C1*n*−1 is obtained. The function of the impedance control circuit 42 shown in FIG. 12 is the same as the function of the impedance control circuit 41.

In the impedance control circuits 41 and 42 shown in FIG. 12, therefore, the switching noises each having a plurality of frequencies respectively generated from the transistors Q1 and Q2 over a wide range are restrained. As a result, the undesired radiation of the electromagnetic wave over a wide band is sufficiently restrained.

(1-8) Effects of First Embodiment

In the sustain driver 4 according to the present embodiment, a bypass region for a plurality of frequency components is formed between the node N1 and the power supply terminal V1 and between the node N1 and the ground terminal by the impedance control circuits 41 and 42. Thus, the switching noises over a wide band respectively generated by the transistors Q1 and Q2 are absorbed in the power supply terminal V1 and the ground terminal through the impedance control circuits 41 and 42, so that the effect of the switching noises on the panel capacitance Cp is reduced. This allows the radiation of the high-frequency electromagnetic wave over a wide band to be sufficiently restrained.

(2) Second Embodiment (2-1) Configuration of Sustain Driver

Figure 14:
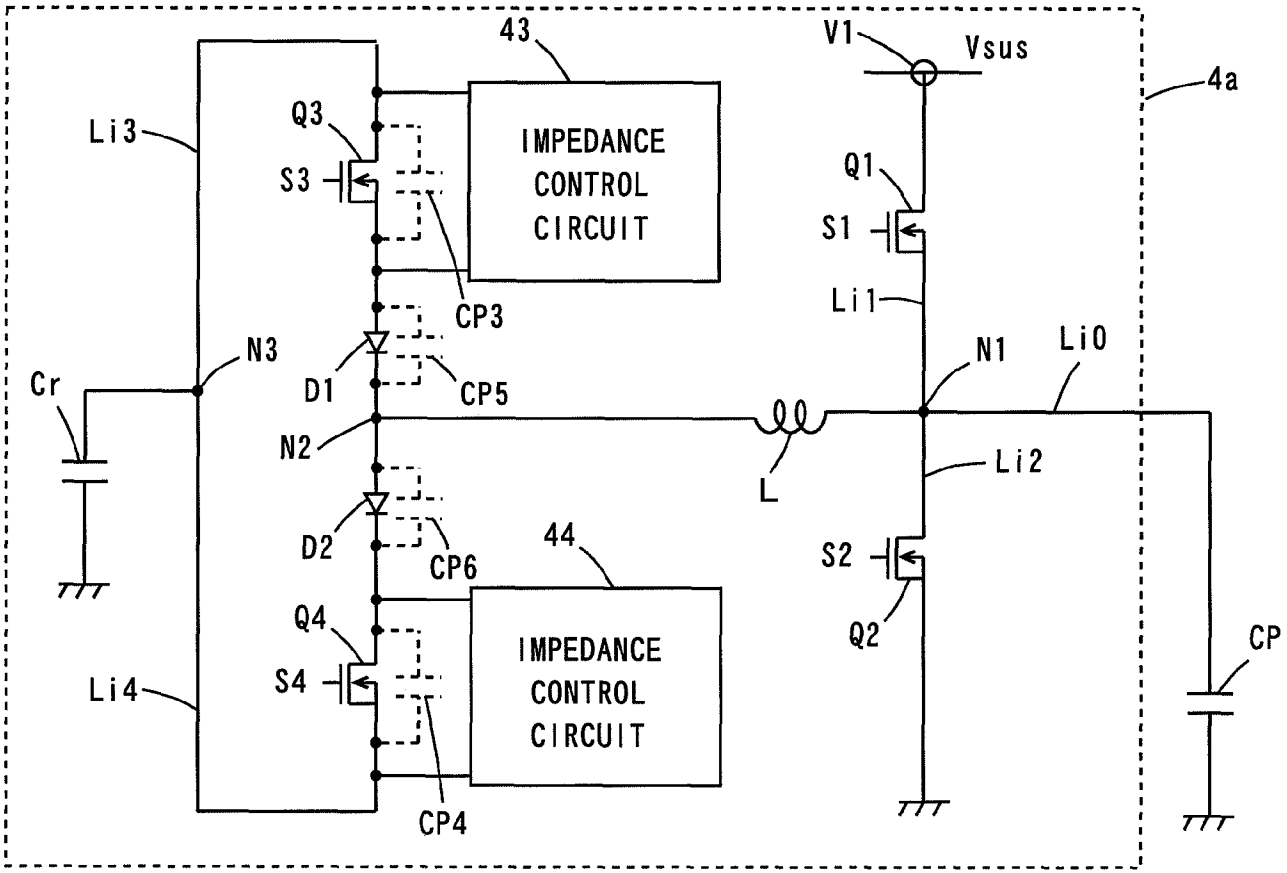
FIG. 14 is a circuit diagram showing the configuration of a sustain driver according to a second embodiment of the present invention.

FIG. 14 is a circuit diagram showing the configuration of a sustain driver according to a second embodiment of the present invention.

The sustain driver 4*a* shown in FIG. 14 are the same as the sustain driver 4 shown in FIG. 3 except for the following points. Therefore, the same units are assigned the same reference numerals and hence, the detailed description is omitted.

As shown in FIG. 14, transistors Q3 and Q4 have respective one ends connected to a node N3 through interconnections Li3 and Li4. The transistor Q3 has the respective other ends connected to an anode of a diode D1 and a cathode of a diode D2.

The transistor Q3 has a drain-source capacitance CP3 as a parasitic capacitance, and an impedance control circuit 43 is connected in parallel with the transistor Q3 between the drain and the source of the transistor Q3. The transistor Q4 has a drain-source capacitance CP4 as a parasitic capacitance, and an impedance control circuit 44 is connected in parallel with the transistor Q4 between the drain and the source of the transistor Q4.

The diode D1 has an anode-cathode capacitance CP5 as a parasitic capacitance. The diode D2 has an anode-cathode capacitance CP6 as a parasitic capacitance.

The configuration and the function of the impedance control circuit 43 are the same as the configuration and the function of the impedance control circuit 41 shown in FIG. 5, 10, or 12. Further, the configuration and the function of the impedance control circuit 44 are the same as the configuration and the function of the impedance control circuit 42 shown in FIG. 5, 10, or 12.

In the present embodiment, it is preferable that respective nodes between capacitors C11 to C1*n* in the impedance control circuit 43 and a transistor Q3 are closer to the source and the drain of the transistor Q3. For example, it is preferable that the capacitors C11 to C1*n* and the transistor Q3 are connected to each other on the same circuit board. This allows the effect, descried later, to be more reliably obtained.

Furthermore, it is preferable that respective nodes between capacitors C21 to C2*n* in the impedance control circuit 44 and a transistor Q4 are closer to the source and the drain of the transistor Q4. For example, it is preferable that the capacitors C21 to C2*n* and the transistor Q4 are connected to each other on the same circuit board. This allows the effect, descried later, to be more reliably obtained.

(2-2) Operation of Sustain Driver

The operation in a sustain time period of the sustain driver 4*a* configured as described above will be then described while referring to FIG. 4.

Since the basic operation of the sustain driver 4*a* shown in FIG. 14 is the same as that of the sustain driver 4 shown in FIG. 3, a mechanism for respectively generating switching noises by the transistors Q3 and Q4 will be mainly described in detail below.

First, when the transistor Q4 is in an OFF state and a rapid voltage change occurs between the drain and the source of the transistor Q4, high-frequency LC resonance is caused by the drain-source capacitance CP4 of the transistor Q4 and an inductance component of the interconnection Li4. Thus, a switching noise having a plurality of frequency components is generated. Specifically, at the time t1 and the time t2 shown in FIG. 4, switching noises each having a plurality of frequencies are respectively generated from the transistors Q3 and Q4 in the following manner.

At the time t1, a control signal S3 enters a high level to turn the transistor Q3 on. Thus, the switching noise having a plurality of frequency components is generated from the transistor Q3 the instant a potential at a node N2 rises from 0 V to a potential of approximately Vsus/2 at the node N3. The switching noise includes a frequency component of LC resonance caused by the drain-source capacitance CP3 of the transistor Q3 and an inductance component of the interconnection Li3 and the other plurality of frequency components.

At the time t2, a potential at a node N1 starts to fall from a peak voltage due to LC resonance caused by a recovery coil L and a panel capacitance Cp, so that the direction of a current flowing through the recovery coil L is reversed from a direction toward the node N1 to a direction toward the node N2. Thus, the diode D1 is rendered non-conductive, so that a current path is interrupted. As a result, the potential at the node N2 rapidly rises toward the potential at the node N1. At this time, high-frequency LC resonance is caused by a stray capacitance connected to the node N2 (e.g., the anode-cathode capacitance CP5 of the diode D1) and the recovery coil L, so that the potential at the node N2 rises while ringing. In this case, the switching noise having a plurality of frequency components is generated from the transistor Q4. The switching noise includes a frequency component of the LC resonance caused by the drain-source capacitance CP4 of the transistor Q4 and the inductance component of the interconnection Li4 and the other plurality of frequency components.

In the present embodiment, since the impedance control circuit 44 is connected in parallel with the transistor Q4, however, the switching noise over a wide band is absorbed in a ground terminal through the impedance control circuit 44 and a recovery capacitor Cr. Thus, the undesired radiation of an electromagnetic wave over a wide band is sufficiently restrained.

Then, when the transistor Q3 is in an OFF state and a rapid voltage change occurs between the drain and the source of the transistor Q3, the high-frequency LC resonance is caused by the drain-source capacitance CP3 of the transistor Q3 and the inductance component of the interconnection Li3. Thus, a switching noise having a plurality of frequency components is generated from the transistor Q3. Specifically, at the time t3 and the time t4 shown in FIG. 4, switching noises each having a plurality of frequencies are respectively generated from the transistors Q3 and Q4 in the following manner.

When a power recovery time period at the rise time of a sustain pulse Psu is terminated, a control signal S1 enters a high level to turn the transistor Q1 on. Thus, a power supply voltage Vsus of a power supply terminal V1 is applied to the node N2. From this state, at the time t3, a control signal S4 enters a high level to turn the transistor Q4 on. Thus, the switching noise having a plurality of frequency components is generated from the transistor Q4 the instant a potential at the node N2 falls from the power supply voltage Vsus to a potential of approximately Vsus/2 at the node N3.

When a power recovery time period at the rise time of the sustain pulse Psu is terminated at the time t4, the direction of a current flowing through the recovery coil L is reversed from a direction toward the node N2 to a direction toward the node N1. Thus, the diode D2 is rendered non-conductive, so that a current path is interrupted. As a result, the potential at the node N2 rapidly falls toward the potential at the node N1. At this time, high-frequency LC resonance is caused by a stray capacitance connected to the node N2 (e.g., the anode-cathode capacitance CP6 of the diode D2) and the recovery coil L, so that the potential at the node N2 falls while ring ing. In this case, the switching noise having a plurality of frequency components is generated from the transistor Q3.

In the present embodiment, since the impedance control circuit 43 is connected in parallel with the transistor Q3, however, the switching noise over a wide band is absorbed in the ground terminal through the impedance control circuit 43 and the recovery capacitor Cr. Thus, the undesired radiation of the electromagnetic wave over a wide band is sufficiently restrained.

(2-3) Effects of Second Embodiment

In the sustain driver 4*a* according to the present embodiment, a bypass region for a plurality of frequency components is formed between the node N1 and the node N3 by the impedance control circuits 43 and 44. Thus, the switching noises over a wide band respectively generated by the transistors Q3 and Q4 are absorbed in the ground terminal through the impedance control circuits 43 and 44 and the recovery capacitor Cr, so that the effect of the switching noises on the panel capacitance Cp is reduced. This allows the radiation of the high-frequency electromagnetic wave over a wide band to be sufficiently restrained.

(3) Third Embodiment (3-1) Configuration of Sustain Driver

Figure 15:
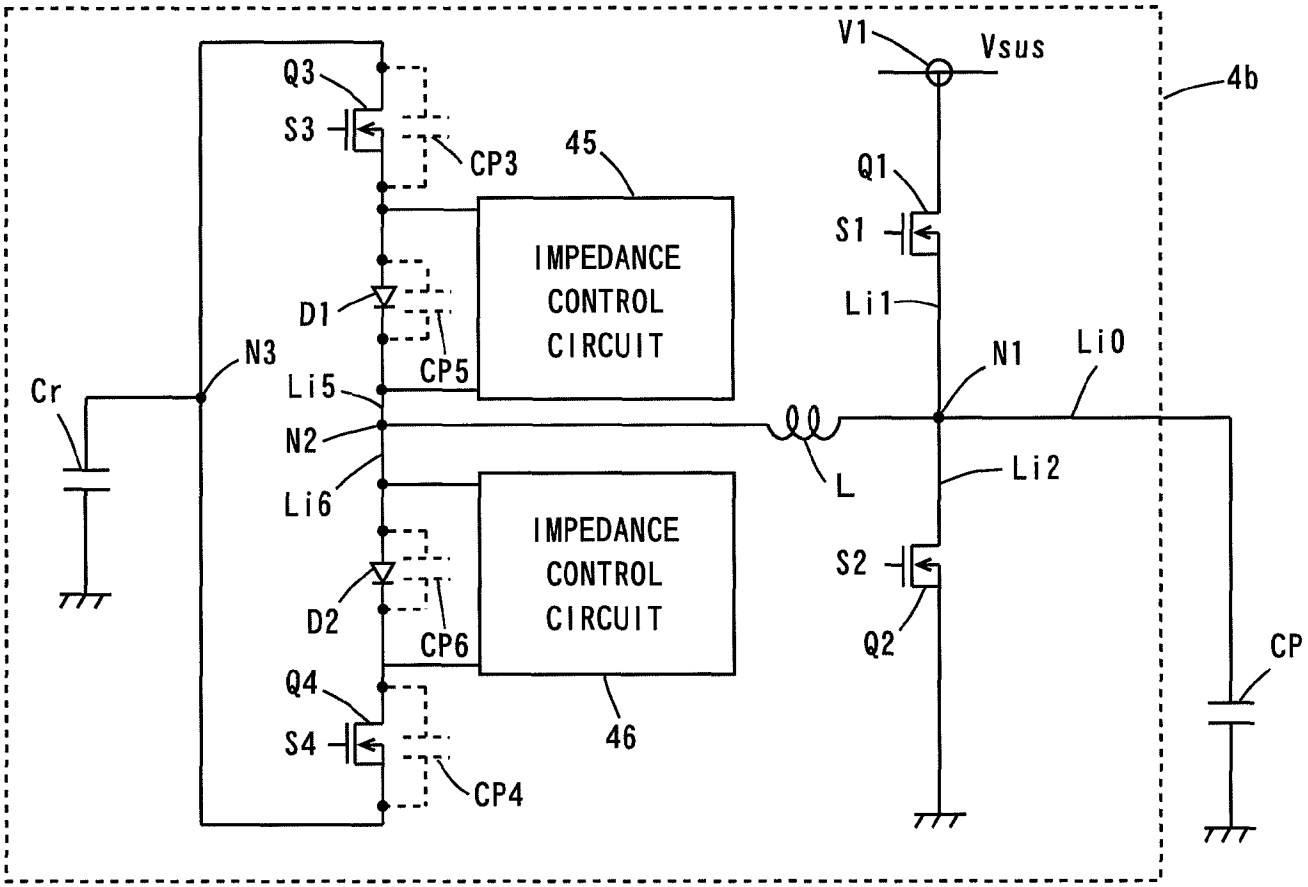
FIG. 15 is a circuit diagram showing the configuration of a sustain driver according to a third embodiment of the present invention.
Figure 16:
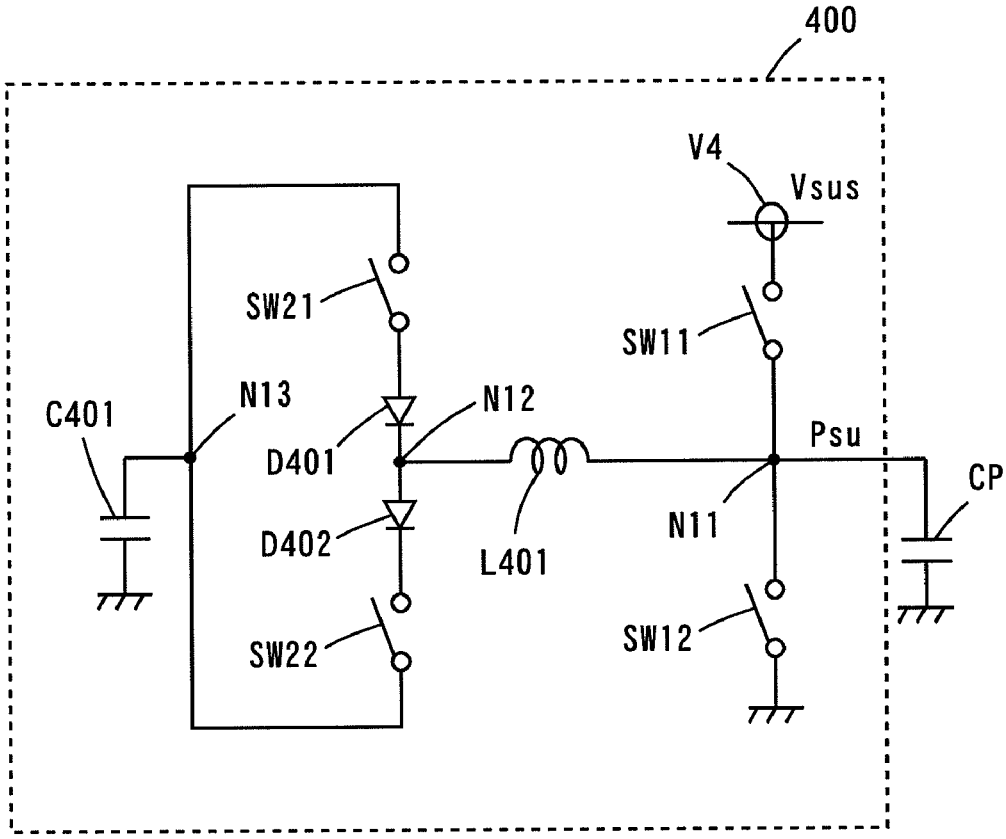
FIG. 16 PRIOR ART
FIG. 16 is a circuit diagram showing the configuration of a conventional sustain driver.
Figure 17:
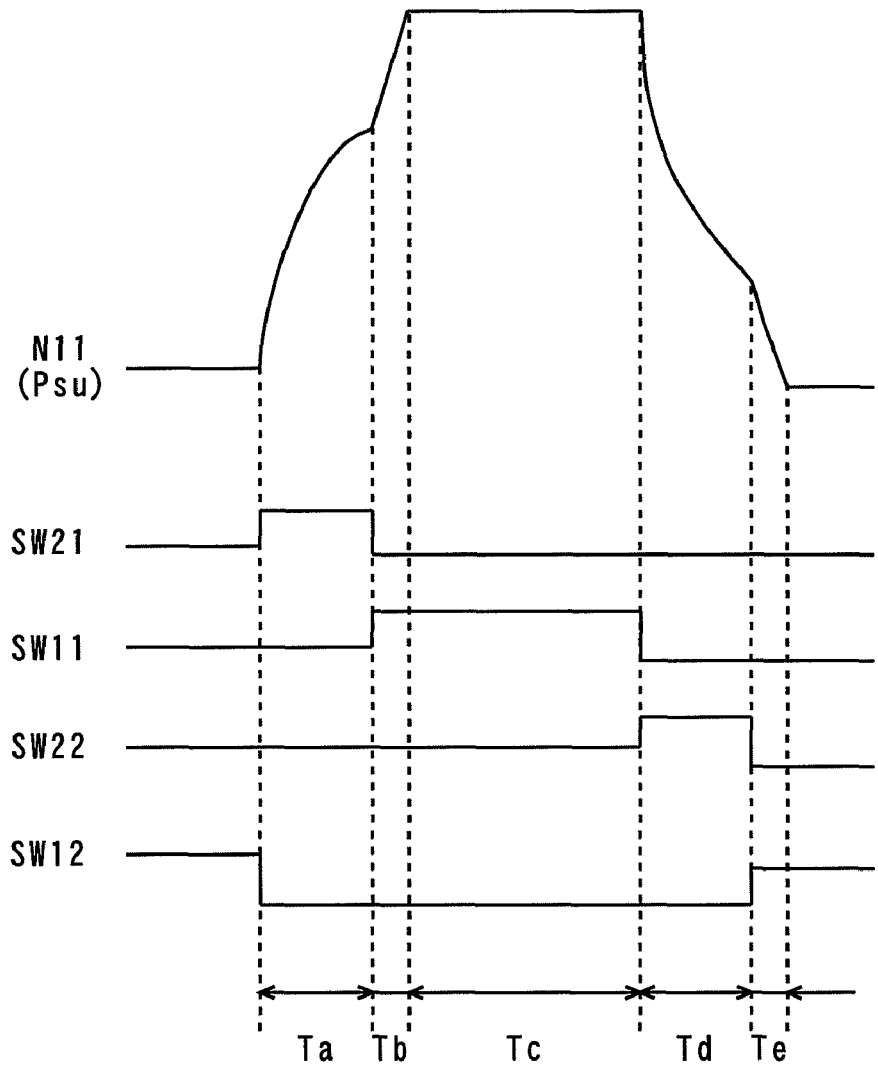
FIG. 17 PRIOR ART
FIG. 17 is a timing chart showing the operation in a sustain time period of the sustain driver shown in FIG. 16.

FIG. 15 is a circuit diagram showing the configuration of a sustain driver according to a third embodiment of the present invention.

The sustain driver 4*b* shown in FIG. 15 are the same as the sustain driver shown in FIG. 3 except for the following points. Therefore, the same units are assigned the same reference numerals and hence, the detailed description thereof is omitted.

As shown in FIG. 15, an impedance control circuit 45 is connected in parallel with a diode D1 between the anode and the cathode of the diode D1. An impedance control circuit 46 is connected in parallel with a diode D2 between the anode and the cathode of the diode D2.

The cathode of the diode D1 and the anode of the diode D2 are respectively connected to a node N2 through interconnections Li5 and Li6. The diode D1 has an anode-cathode capacitance CP5 as a parasitic capacitance, and the diode D2 has an anode-cathode capacitance CP6 as a parasitic capacitance. Note that transistors Q3 and Q4 respectively have parasitic capacitances CP3 and CP4, as in the second embodiment.

The configuration and the function of the impedance control circuit 45 are the same as the configuration and the function of the impedance control circuit 41 shown in FIG. 5, 10 or 12. Further, the configuration and the function of the impedance control circuit 46 are the same as the configuration and the function of the impedance control circuit 42 shown in FIG. 5, 10 or 12.

In the present embodiment, it is preferable that respective nodes between capacitors C11 to C1*n* in the impedance control circuit 45 and the diode D1 are closer to the anode and the cathode of the diode D1. For example, it is preferable that the capacitors C11 to C1*n* and the diode D1 are connected to each other on the same circuit board. This allows the effect, descried later, to be more reliably obtained.

Furthermore, it is preferable that respective nodes between capacitors C21 to C2*n* in the impedance control circuit 46 and the diode D2 are closer to the anode and the cathode of the diode D2. For example, it is preferable that the capacitors C21 to C2*n* and the diode D2 are connected to each other on the same circuit board. This allows the effect, descried later, to be more reliably obtained.

(3-2) Operation of Sustain Driver

The operation in a sustain time period of the sustain driver 4*b* configured as described above will be then described while referring to FIG. 4.

Since the basic operation of the sustain driver 4*b* shown in FIG. 15 is the same as those of the sustain drivers 4 and 4*a* shown in FIGS. 3 and 14, a mechanism for respectively generating switching noises by the diodes D1 and D2 will be mainly described in detail below.

First, when the diode D1 is in an OFF state and a rapid voltage change occurs between the anode and the cathode of the diode D1, a switching noise having a plurality of frequency components is generated from the diode D1. Specifically, at the time t2 shown in FIG. 4, the switching noise having a plurality of frequency components is generated from the diode D1 in the following manner.

At the time t1, a control signal S3 enters a high level to turn the transistor Q3 on. Thus, a potential at the node N2 is equal to a potential of approximately Vsus/2 at a node N3. In this state, at the time t2, a potential at a node N1 starts to fall from a peak voltage due to LC resonance caused by a recovery coil L and a panel capacitance Cp, so that the direction of a current flowing through the recovery coil L is reversed from a direction toward the node N1 to a direction toward the node N2. Thus, the diode D1 is rendered non-conductive, so that a current path is interrupted. As a result, the potential at the node N2 rapidly rises toward the potential at the node N1. At this time, the switching noise having a plurality of frequency components is generated from the diode D1. The switching noise includes a frequency component of LC resonance caused by the anode-cathode capacitance CP5 of the diode D1 and an inductance component of an interconnection Li5 and the other plurality of frequency components.

In the present embodiment, since the impedance control circuit 45 is connected in parallel with the diode D1, however, the switching noise having a plurality of frequency components generated from the diode D1 flows to the transistor Q3 through the impedance control circuit 45. At this time, the transistor Q3 is turned on. Consequently, the switching noise having a plurality of frequency components generated from the diode D1 is absorbed in a ground terminal through the impedance control circuit 45, the transistor Q3, and a recovery capacitor Cr. As a result, the undesired radiation of an electromagnetic wave over a wide band is sufficiently restrained. At this time, the recovery coil L exists. Therefore, the switching noise does not flow to the panel capacitance Cp and transistors Q1 and Q2.

Then, when the diode D2 is in an OFF state and a rapid voltage change occurs between the anode and the cathode of the diode D2, a switching noise having a plurality of frequency components is generated from the diode D2. Specifically, at the time t4 shown in FIG. 4, the switching noise having a plurality of frequency components is generated from the diode D2 in the following manner.

When a power recovery time period at the fall time of a sustain pulse Psu is terminated at the time t4, the direction of a current flowing through the recovery coil L is reversed from a direction toward the node N2 to a direction toward the node N1. Thus, the diode D2 is rendered non-conductive, so that a current path is interrupted. As a result, the potential at the node N2 rapidly falls toward the potential at the node N1. At this time, the switching noise having a plurality of frequency components is generated from the diode D2. The switching noise includes a frequency component of LC resonance caused by the anode-cathode capacitance CP6 of the diode D2 and an inductance component of an interconnection Li6 and the other plurality of frequency components.

In the present embodiment, since the impedance control circuit 46 is connected in parallel with the diode D2, however, the switching noise having a plurality of frequency components generated from the diode D2 flows to the transistor Q4 through the impedance control circuit 46. At this time, the transistor Q4 is turned on. Consequently, the switching noise having a plurality of frequency components generated from the diode D2 is absorbed in the ground terminal through the impedance control circuit 46, the transistor Q4, and the recovery capacitor Cr. As a result, the undesired radiation of the electromagnetic wave over a wide band is sufficiently restrained. At this time, the recovery coil L exists. Therefore, the switching noise does not flow to the panel capacitance Cp and the transistors Q1 and Q2.

(3-3) Effects of Third Embodiment

In the sustain driver 4*b* according to the present embodiment, a bypass region for a plurality of frequency components is formed between the node N2 and the transistor Q3 and between the node N2 and the transistor Q4 by the impedance control circuits 45 and 46. Thus, the switching noises over a wide band respectively generated from the diodes D1 and D2 are absorbed in the ground terminal through the impedance control circuits 45 and 46 and the recovery capacitor Cr, so that the effect of the switching noises on the panel capacitance Cp is reduced. This allows the radiation of the high-frequency electromagnetic wave over a wide band to be sufficiently restrained.

(4) Another Embodiment (4-1)

Impedance control circuits 43 and 44 shown in FIG. 14 may be connected in parallel with transistors Q3 and Q4 in addition to the impedance control circuits 41 and 42 in the sustain driver 4 shown in FIG. 3.

In this case, switching noises over a wide band respectively generated by transistors Q1 and Q2 are absorbed in a power supply terminal V1 and a ground terminal through the impedance control circuits 41 and 42, and switching noises over a wide band respectively generated by the transistors Q3 and Q4 are absorbed in the ground terminal through the impedance control circuits 43 and 44 and a recovery capacitor Cr, so that the effect of the switching noises on a panel capacitance Cp is reduced. This allows the radiation of a high-frequency electromagnetic wave over a wide band to be sufficiently restrained.

(4-2)

Impedance control circuits 45 and 46 shown in FIG. 15 may be connected in parallel with diodes D1 and D2 in addition to the impedance control circuits 41 and 42 in the sustain driver 4 shown in FIG. 3.

In this case, switching noises over a wide band respectively generated by transistors Q1 and Q2 are absorbed in a power supply terminal V1 and a ground terminal through the impedance control circuits 41 and 42, and switching noises over a wide band respectively generated by the diodes D1 and D2 are absorbed in the ground terminal through the impedance control circuits 45 and 46 and a recovery capacitor Cr, so that the effect of the switching noises on a panel capacitance Cp is reduced. This allows the radiation of a high-frequency electromagnetic wave over a wide band to be sufficiently restrained.

(4-3)

Impedance control circuits 43 and 44 shown in FIG. 14 may be connected in parallel with transistors Q3 and Q4, and impedance control circuits 45 and 46 shown in FIG. 15 may be connected in parallel with diodes D1 and D2 in addition to the impedance control circuits 41 and 42 in the sustain driver 3 shown in FIG. 3.

In this case, switching noises over a wide band respectively generated by transistors Q1 and Q2 are absorbed in a power supply terminal V1 and a ground terminal through the impedance control circuits 41 and 42, and switching noises over a wide band respectively generated by the transistors Q3 and Q4 and the diodes D1 and D2 are absorbed in the ground terminal through the impedance control circuits 43, 44, 45, and 46 and a recovery capacitor Cr, so that the effect of the switching noises on a panel capacitance Cp is reduced. This allows the radiation of a high-frequency electromagnetic wave over a wide band to be sufficiently restrained.

(4-4)

Impedance control circuits 45 and 46 shown in FIG. 15 may be connected in parallel with diodes D1 and D2 in addition to the impedance control circuits 43 and 44 in the sustain driver 4 shown in FIG. 14.

In this case, switching noises over a wide band respectively generated by transistors Q3 and Q4 and diodes D1 and D2 are absorbed in a ground terminal through the impedance control circuits 43, 44, 45, and 46 and a recovery capacitor Cr, so that the effect of the switching noises on a panel capacitance Cp is reduced. This allows the radiation of a high-frequency electromagnetic wave over a wide band to be sufficiently restrained.

(4-5)

The drive circuit according to the present invention is not limited to the sustain driver. For example, the present invention is also applicable to a data driver serving as a drive circuit for driving an address electrode. Alternatively, it is also applicable to a scan driver 3 serving as a drive circuit for driving a scan electrode. The drive circuit according to the present invention is suitably used for drive circuits for a sustain electrode and a scan electrode.

(4-6)

The drive circuit according to the present invention is also applicable to drive circuits for PDPs of any types such as an AC type and a DC type.

(4-7)

The drive circuit according to the present invention is not limited to the PDP. The present invention is also similarly applicable to other devices for driving a capacitive load. The drive circuit according to the present invention is also applicable to other display devices such as a liquid crystal display and an electroluminescence display, for example.

(4-8)

The transistors Q1, Q2, Q3, and Q4 may be replaced with other switching elements such as a bipolar transistor.

(4-9)

The diodes D1 and D2 may be replaced with other unidirectional conductive elements such as a transistor.

(4-10)

As the capacitors C11 to C1*n* and the capacitors C21 to C2*n*, the stacked ceramic capacitor may be replaced with a capacitive element composed of other materials such as tantalum oxide or niobium oxide.

As described in the foregoing, as the capacitors C11 to C1*n* and the capacitors C21 to C2*n*, the stacked ceramic capacitor may be replaced with a tantalum electrolytic capacitor or an aluminum electrolytic capacitor.

(5) Correspondences Between Elements in the Claims and Parts in Embodiments

In the following two paragraphs, non-limiting examples of correspondences between various elements recited in the claims below and those described above with respect to various preferred embodiments of the present invention are explained.

In the preferred embodiments described above, the discharge cell DC corresponds to a display element, the panel capacitance Cp corresponds to a capacitive load, the interconnection Li0 corresponds to a pulse supply path, and the PDP1 corresponds to a display panel.

The transistor Q1 corresponds to a first switching element, the transistor Q2 corresponds to a second switching element, the transistor Q3 corresponds to a third switching element, the transistor Q4 corresponds to a fourth switching element, the recovery coil L corresponds to an inductance element, the recovery capacitor Cr corresponds to a recovering capacitive element, the diode D1 corresponds to a unidirectional conductive element, and the diode D2 corresponds to a unidirectional conductive element.

The interconnection Li1 corresponds to a first interconnection, the interconnection Li2 corresponds to a second interconnection, the power supply terminal V1 corresponds to a first voltage source, the ground terminal corresponds to a second voltage source, the power supply voltage Vsus corresponds to a first voltage, and the ground potential corresponds to a second voltage.

Furthermore, the impedance control circuit 41 corresponds to a first impedance control circuit, the impedance control circuit 42 corresponds to a second impedance control circuit, the capacitors C11 to C1*n* correspond to a plurality of first capacitive elements or first to n-th first capacitive elements, the capacitors C21 to C2*n* correspond to a plurality of second capacitive elements or first to n-th second capacitive elements.

The resistive elements R11 to R1*n*−1 correspond to a plurality of first resistive elements or first to (n−1)-th first resistive elements, the resistive elements R21 to R2*n*−1 correspond to a plurality of second resistive elements or first to (n−1)-th second resistive elements, the beads cores L11 to L1*n*−1 correspond to a plurality of first beads cores or first to (n−1)-th first beads cores, and the beads cores L21 to L2*n*−1 correspond to a plurality of second beads cores or first to (n−1)-th second beads cores.

The impedance control circuit 43 corresponds to a first or third impedance control circuit, and the impedance control circuit 44 corresponds to a second or fourth impedance control circuit.

The impedance control circuit 45 corresponds to a first or third impedance control circuit, and the impedance control circuit 46 corresponds to a second or fourth impedance control circuit.

INDUSTRIAL APPLICABILITY

The present invention is applicable to various drive circuits for driving a capacitive load and various devices such as display devices having a capacitive load.

The invention claimed is:

1. A drive circuit for supplying a driving pulse to a capacitive load including a display element of a plasma display panel through a pulse supply path, comprising:

a first voltage source that supplies a first voltage to raise said driving pulse;

a second voltage source that supplies a second voltage lower than said first voltage to lower said driving pulse;

a first switching element having one end receiving the first voltage from said first voltage source;

a second switching element having one end receiving the second voltage from said second voltage source;

a first interconnection having one end connected to the other end of said first switching element and the other end connected to said pulse supply path;

a second interconnection having one end connected to the other end of said second switching element and the other end connected to said pulse supply path;

a first impedance control circuit connected in parallel with said first switching element between the one end and the other end of said first switching element; and a second impedance control circuit connected in parallel with said second switching element between the one end and the other end of said second switching element, wherein said first and second switching elements operate to apply the driving pulse to said capacitive load in a sustain time period during which said display element is lightened, said first impedance control circuit includes a plurality of first capacitive elements connected in parallel with said first switching element, said second impedance control circuit includes a plurality of second capacitive elements connected in parallel with said second switching element, each of said plurality of first capacitive elements includes a capacitance component and an inductance component, and the values of the capacitance components in said plurality of first capacitive elements differ from one another, each of said plurality of second capacitive elements includes a capacitance component and an inductance component, and the values of the capacitance components in said plurality of second capacitive elements differ from one another, the values of the capacitance components in said plurality of first capacitive elements are set such that a plurality of peak frequencies of switching noises generated by said first switching element are not positioned within an anti-resonance frequency band of a parallel circuit of said plurality of first capacitive elements, and the values of the capacitance components in said plurality of second capacitive elements are set such that a plurality of peak frequencies of switching noises generated by said second switching element are not positioned within an anti-resonance frequency band of a parallel circuit of said plurality of second capacitive elements.

2. The drive circuit according to claim 1, further comprising an inductance element having one end connected to said capacitive load through the pulse supply path, a recovering capacitive element for recovering charges from said capacitive load, first and second unidirectional conductive elements, and third and fourth switching elements, wherein said first unidirectional conductive element and said third switching element are connected in series between the other end of said inductance element and said recovering capacitive load so as to allow the supply of a current from said recovering capacitive element to said inductance element, and said second unidirectional conductive element and said fourth switching element are connected in series between the other end of said inductance element and said recovering capacitive element so as to allow the supply of a current from said inductance element to said recovering capacitive element.

3. The drive circuit according to claim 2, further comprising a third impedance control circuit connected in parallel with said third switching element, and a fourth impedance control circuit connected in parallel with said fourth switching element, wherein said third impedance control circuit includes a plurality of third capacitive elements connected in parallel with said third switching element, said fourth impedance control circuit includes a plurality of fourth capacitive elements connected in parallel with said fourth switching element, each of said plurality of third capacitive elements includes a capacitance component and an inductance component, and the values of the capacitance components in said plurality of third capacitive elements differ from one another, and each of said plurality of fourth capacitive elements includes a capacitance component and an inductance component, and the values of the capacitance components in said plurality of fourth capacitive elements differ from one another, the values of the capacitance components in said plurality of third capacitive elements are set such that a plurality of peak frequencies of switching noises generated by said third switching element are not positioned within an anti-resonance frequency band of a parallel circuit of said plurality of third capacitive elements, and the values of the capacitance components in said plurality of fourth capacitive elements are set such that a plurality of peak frequencies of switching noises generated by said fourth switching element are not positioned within an anti-resonance frequency band of a parallel circuit of said plurality of fourth capacitive elements.

4. The drive circuit according to claim 2, further comprising a third impedance control circuit connected in parallel with said first unidirectional conductive element, and a fourth impedance control circuit connected in parallel with said second unidirectional conductive element, wherein said third impedance control circuit includes a plurality of third capacitive elements connected in parallel with said first unidirectional conductive element, said fourth impedance control circuit includes a plurality of fourth capacitive elements connected in parallel with said second unidirectional conductive element, each of said plurality of third capacitive elements includes a capacitance component and an inductance component, and the values of the capacitance components in said plurality of third capacitive elements differ from one another, and each of said plurality of fourth capacitive elements includes a capacitance component and an inductance component, and the values of the capacitance components in said plurality of fourth capacitive elements differ from one another, the values of the capacitance components in said plurality of third capacitive elements are set such that a plurality of peak frequencies of switching noises generated by said first unidirectional conductive element are not positioned within an anti-resonance frequency band of a parallel circuit of said plurality of third capacitive elements, and the values of the capacitance components in said plurality of fourth capacitive elements are set such that a plurality of peak frequencies of switching noises generated by said second unidirectional conductive element are not positioned within an anti-resonance frequency band of a parallel circuit of said plurality of fourth capacitive elements.

5. The drive circuit according to claim 1, wherein said plurality of first capacitive elements include first to n-th first capacitive elements, said plurality of second capacitive elements include first to n-th second capacitive elements, and n is a natural number of not less than two, said n-th first capacitive element out of said first to n-th first capacitive elements has the smallest capacitance value, said n-th second capacitive element out of said first to n-th second capacitive elements has the smallest capacitance value, said first impedance control circuit further includes first to (n−1)-th first resistive elements respectively connected in series with said first to (n−1)-th first capacitive elements, and said second impedance control circuit further includes first to (n−1)-th second resistive elements respectively connected in series with said first to (n−1)-th second capacitive elements.

6. The drive circuit according to claim 1, wherein said plurality of first capacitive elements include first to n-th first capacitive elements, said plurality of second capacitive elements include first to n-th second capacitive elements, and n is a natural number of not less than two, said n-th first capacitive element out of said first to n-th first capacitive elements has the smallest capacitance value, said n-th second capacitive element out of said first to n-th second capacitive elements has the smallest capacitance value, said first impedance control circuit further includes first to (n−1)-th first bead type inductors respectively connected in series with said first to (n−1)-th first capacitive elements, and said second impedance control circuit further includes first to (n−1)-th second bead type inductors respectively connected in series with said first to (n−1)-th second capacitive elements.

7. The drive circuit according to claim 1, wherein each of said plurality of first capacitive elements is composed of a first stacked ceramic capacitor, and each of said plurality of second capacitive elements is composed of a second stacked ceramic capacitor.

8. A drive circuit for supplying a driving pulse to a capacitive load including a display element of a plasma display panel through a pulse supply path, comprising:

a first voltage source that supplies a first voltage to raise said driving pulse;

a second voltage source that supplies a second voltage lower than said first voltage to lower said driving pulse;

first, second, third and fourth switching elements;

an inductance element having one end connected to said capacitive load through the pulse supply path;

a recovering capacitive element for recovering charges from said capacitive load;

first and second unidirectional conductive elements;

a first impedance control circuit connected in parallel with said third switching element; and a second impedance control circuit connected in parallel with said fourth switching element, wherein said first switching element is connected between said first voltage source and said pulse supply path, said second switching element is connected between said second voltage source and said pulse supply path, said first and second switching elements operate to apply the driving pulse to said capacitive load in a sustain time period during which said display element is lighten lightened, said first unidirectional conductive element and said third switching element are connected in series between the other end of said inductance element and said recovering capacitive load so as to allow the supply of a current from said recovering capacitive element to said inductance element, and said second unidirectional conductive element and said fourth switching element are connected in series between the other end of said inductance element and said recovering capacitive element so as to allow the supply of a current from said inductance element to said recovering capacitive element, said first impedance control circuit includes a plurality of first capacitive elements connected in parallel with said third switching element, said second impedance control circuit includes a plurality of second capacitive elements connected in parallel with said fourth switching element, each of said plurality of first capacitive elements includes a capacitance component and an inductance component, and the values of the capacitance components in said plurality of first capacitive elements differ from one another, each of said plurality of second capacitive elements includes a capacitance component and an inductance component, and the values of the capacitance components in said plurality of second capacitive elements differ from one another, the values of the capacitance components in said plurality of first capacitive elements are set such that a plurality of peak frequencies of switching noises generated by said third switching element are not positioned within an anti-resonance frequency band of a parallel circuit of said plurality of first capacitive elements, and the values of the capacitance components in said plurality of second capacitive elements are set such that a plurality of peak frequencies of switching noises generated by said fourth switching element are not positioned within an anti-resonance frequency band of a parallel circuit of said plurality of second capacitive elements.

9. A drive circuit for supplying a driving pulse to a capacitive load including a display element of a plasma display panel through a pulse supply path, comprising:

a first voltage source that supplies a first voltage to raise said driving pulse;

a second voltage source that supplies a second voltage lower than said first voltage to lower said driving pulse;

first, second, third and fourth switching elements;

an inductance element having one end connected to said capacitive load through the pulse supply path;

a recovering capacitive element for recovering charges from said capacitive load, first and second unidirectional conductive elements;

a first impedance control circuit connected in parallel with said first unidirectional conductive element; and a second impedance control circuit connected in parallel with said second unidirectional conductive element, wherein said first switching element is connected between said first voltage source and said pulse supply path, said second switching element is connected between said second voltage source and said pulse supply path, said first and second switching elements operate to apply the driving pulse to said capacitive load in a sustain time period during which said display element is lightened, said first unidirectional conductive element and said third switching element are connected in series between the other end of said inductance element and said recovering capacitive load so as to allow the supply of a current from said recovering capacitive element to said inductance element, said second unidirectional conductive element and said fourth switching element are connected in series between the other end of said inductance element and said recovering capacitive element so as to allow the supply of a current from said inductance element to said recovering capacitive element, said first impedance control circuit includes a plurality of first capacitive elements connected in parallel with said first unidirectional conductive element, said second impedance control circuit includes a plurality of second capacitive elements connected in parallel with said second unidirectional conductive element, each of said plurality of first capacitive elements includes a capacitance component and an inductance component, and the values of the capacitance components in said plurality of first capacitive elements differ from one another, and each of said plurality of second capacitive elements includes a capacitance component and an inductance component, and the values of the capacitance components in said plurality of second capacitive elements differ from one another, the values of the capacitance components in said plurality of first capacitive elements are set such that a plurality of peak frequencies of switching noises generated by said first unidirectional conductive element are not positioned within an anti-resonance frequency band of a parallel circuit of said plurality of first capacitive elements, and the values of the capacitance components in said plurality of second capacitive elements are set such that a plurality of peak frequencies of switching noises generated by said second unidirectional conductive element are not positioned within an anti-resonance frequency band of a parallel circuit of said plurality of second capacitive elements.

10. A display device of a plasma display panel, comprising:

a display panel including a capacitive element composed of a plurality of display elements; and a drive circuit for supplying a driving pulse to said capacitive load through a pulse supply path, wherein said drive circuit includes a first voltage source that supplies a first voltage to raise said driving pulse, a second voltage source that supplies a second voltage lower than said first voltage to lower said driving pulse, a first switching element having one end receiving the first voltage from said first voltage source, a second switching element having one end receiving the second voltage from said second voltage source, a first interconnection having one end connected to the other end of said first switching element and the other end connected to said pulse supply path, a second interconnection having one end connected to the other end of said second switching element and the other end connected to said pulse supply path, a first impedance control circuit connected in parallel with said first switching element between the one end and the other end of said first switching element, and a second impedance control circuit connected in parallel with said second switching element between the one end and the other end of said second switching element, said first and second switching elements operate to apply the driving pulse to said capacitive load in a sustain time period during which said display element is lightened, said first impedance control circuit includes a plurality of first capacitive elements connected in parallel with said first switching element, said second impedance control circuit includes a plurality of second capacitive elements connected in parallel with said second switching element, each of said plurality of first capacitive elements includes a capacitance component and an inductance component, and the values of the capacitance components in said plurality of first capacitive elements differ from one another, and each of said plurality of second capacitive elements includes a capacitance component and an inductance component, and the values of the capacitance components in said plurality of second capacitive elements differ from one another, the values of the capacitance components in said plurality of first capacitive elements are set such that a plurality of peak frequencies of switching noises generated by said first switching element are not positioned within an anti-resonance frequency band of a parallel circuit of said plurality of first capacitive elements, and the values of the capacitance components in said plurality of second capacitive elements are set such that a plurality of peak frequencies of switching noises generated by said second switching element are not positioned within an anti-resonance frequency band of a parallel circuit of said plurality of second capacitive elements.

* * * * *